US010376771B2

(12) United States Patent
Rouzier et al.

(10) Patent No.: US 10,376,771 B2
(45) Date of Patent: Aug. 13, 2019

(54) ICE SKATE

(71) Applicant: BAUER HOCKEY, LLC, Exeter, NH (US)

(72) Inventors: Edouard Rouzier, Montreal (CA); Alexis Seguin, Laval (CA); Ivan Labonte, Montreal (CA); Jean-Francois Corbeil, Prevost (CA)

(73) Assignee: BAUER HOCKEY, LLC, Exeter, NH (US)

( * ) Notice: Subject to any disclaimer, the term of this patent is extended or adjusted under 35 U.S.C. 154(b) by 0 days.

(21) Appl. No.: 15/670,500

(22) Filed: Aug. 7, 2017

(65) Prior Publication Data

US 2018/0117448 A1 May 3, 2018

Related U.S. Application Data

(63) Continuation of application No. 15/199,179, filed on Jun. 30, 2016.

(51) Int. Cl.

| | |
|---|---|
| ***A63C 1/30*** | (2006.01) |
| ***A63C 1/02*** | (2006.01) |
| ***A63C 1/24*** | (2006.01) |
| ***A63C 1/32*** | (2006.01) |

(52) U.S. Cl.

CPC ..... *A63C 1/30* (2013.01); *A63C 1/02* (2013.01); *A63C 1/24* (2013.01); *A63C 1/303* (2013.01); *A63C 1/32* (2013.01); *A63C 2203/08* (2013.01); *A63C 2203/20* (2013.01); *A63C 2203/42* (2013.01)

(58) Field of Classification Search

CPC .. A63C 1/30; A63C 1/303; A63C 1/34; A63C 1/02; A63C 1/24; A63C 1/32; A63C 2203/08; A63C 2203/20; A63C 2203/42

USPC ..... 280/11.12, 11.15, 11.17

See application file for complete search history.

(56) References Cited

U.S. PATENT DOCUMENTS

| | | | |
|---|---|---|---|
| 37,934 | A | 3/1863 | Yates |
| 1,371,609 | A | 3/1921 | Drevitson |
| 1,666,690 | A | 4/1928 | Drevitson |

(Continued)

FOREIGN PATENT DOCUMENTS

| | | |
|---|---|---|
| CA | 2638352 | 2/2009 |
| DE | 545394 | 3/1932 |

(Continued)

OTHER PUBLICATIONS

Non-final Office Action dated May 17, 2017 in connection with U.S. Appl. No. 14/988,191, 25 pages.

(Continued)

*Primary Examiner* — John D Walters

(57) ABSTRACT

A blade holder for an ice skate (e.g., for playing hockey). The ice skate comprises a skate boot for receiving a foot of a skater. The blade holder comprises a blade-retaining base to retain a blade and a support extending upwardly from the blade-retaining base to interconnect the blade holder and the skate boot. Visual characteristics of the blade holder may enhance its aesthetics and/or other aspects related to its visual appearance (e.g., an effect on the skater, elaborateness and/or customization of its visual appearance, etc.). The blade holder may be lightweight and/or provide other performance benefits to the skater.

31 Claims, 37 Drawing Sheets

(56) References Cited

U.S. PATENT DOCUMENTS

| | | | | | |
|---|---|---|---|---|---|
| 1,773,017 | A | | 8/1930 | Thompson | |
| 4,008,901 | A | * | 2/1977 | Conn | A63C 17/18 280/11.3 |
| 4,218,069 | A | | 8/1980 | Baikie | |
| 4,509,276 | A | | 4/1985 | Bourque | |
| 4,549,742 | A | | 10/1985 | Husak | |
| 5,248,156 | A | | 9/1993 | Cann | |
| 5,326,115 | A | | 5/1994 | Seltzer | |
| 5,332,242 | A | | 7/1994 | Cann | |
| 5,484,148 | A | | 1/1996 | Olivieri | |
| 5,505,467 | A | | 4/1996 | Hill | |
| 5,641,169 | A | | 6/1997 | Bekessy | |
| 5,769,434 | A | * | 6/1998 | Wurthner | A63C 1/30 280/11.12 |
| 5,839,734 | A | * | 11/1998 | Steinhauser, Jr. | A43B 5/1633 280/7.13 |
| 5,988,683 | A | | 11/1999 | Venier | |
| 6,105,975 | A | | 8/2000 | Shum | |
| 6,109,622 | A | | 8/2000 | Reynolds | |
| 6,164,667 | A | | 12/2000 | Olivieri | |
| 6,485,033 | B2 | | 11/2002 | Nicoletti | |
| 6,761,363 | B2 | | 7/2004 | Fask | |
| 7,380,801 | B2 | | 6/2008 | Rudolph | |
| 7,628,405 | B2 | | 12/2009 | Smith | |
| 7,673,884 | B2 | | 3/2010 | Wurthner | |
| 7,758,053 | B2 | | 7/2010 | Wylie | |
| 7,806,418 | B2 | * | 10/2010 | Labonte | A63C 1/02 280/11.12 |
| 7,866,675 | B2 | | 1/2011 | Hauser | |
| 7,896,363 | B2 | | 3/2011 | Lovejoy | |
| 8,109,536 | B2 | | 2/2012 | Labonté | |
| D659,216 | S | | 5/2012 | Wuerthner | |
| 8,277,284 | B2 | | 10/2012 | Wilson | |
| 8,329,083 | B2 | | 11/2012 | Jou | |
| 8,353,535 | B2 | | 1/2013 | Salmon | |
| 8,505,217 | B2 | | 8/2013 | Stewart | |
| 8,770,595 | B2 | * | 7/2014 | Cruikshank | A63C 1/22 280/11.14 |
| 8,857,823 | B2 | * | 10/2014 | Mars | A63C 1/28 280/11.15 |
| 9,084,927 | B2 | * | 7/2015 | Lewis | A63C 17/26 |
| 9,186,569 | B2 | * | 11/2015 | Wuerthner | A63C 1/303 |
| 9,295,901 | B2 | | 3/2016 | Cruikshank | |
| 10,195,514 | B2 | * | 2/2019 | Davis | A63C 1/303 |
| 2003/0011150 | A1 | | 1/2003 | Goldsmith | |
| 2004/0140631 | A1 | | 7/2004 | Goldsmith | |
| 2006/0082081 | A1 | | 4/2006 | Loveridge | |
| 2006/0108751 | A1 | | 5/2006 | Labonté | |
| 2008/0100008 | A1 | | 5/2008 | Wan | |
| 2009/0045616 | A1 | | 2/2009 | Eldridge | |
| 2009/0224494 | A1 | | 9/2009 | Wan | |
| 2009/0289427 | A1 | | 11/2009 | Lovejoy | |
| 2010/0176564 | A1 | | 7/2010 | Koyess | |
| 2010/0192412 | A1 | | 8/2010 | Stewart | |
| 2011/0001297 | A1 | | 1/2011 | Labonté | |
| 2011/0198834 | A1 | | 8/2011 | Olivieri | |
| 2012/0187642 | A1 | | 7/2012 | Corbeil | |
| 2012/0317842 | A1 | | 12/2012 | McClelland | |
| 2013/0038031 | A1 | | 2/2013 | Cruikshank | |
| 2014/0250733 | A1 | | 9/2014 | Cruikshank | |
| 2014/0252736 | A1 | | 9/2014 | Lefebvre | |
| 2014/0265175 | A1 | | 9/2014 | Labonté | |
| 2016/0001162 | A1 | | 1/2016 | Azzolin | |
| 2016/0236065 | A1 | | 8/2016 | Cruikshank | |
| 2018/0361224 | A1 | | 12/2018 | Labonté | |

FOREIGN PATENT DOCUMENTS

| | | |
|---|---|---|
| EP | 1 013 314 | 6/2000 |
| EP | 2478937 | 7/2012 |
| EP | 3415205 | 12/2018 |
| WO | WO 2013/022787 | 2/2013 |

OTHER PUBLICATIONS

Final Office Action dated Dec. 21, 2017 in connection with U.S. Appl. No. 14/488,191, 11 pages.
Advisory Action dated Mar. 22, 2018 in connection with U.S. Appl. No. 14/488,191, 3 pages.
Non-Final Office Action issued by the USPTO dated Jun. 20, 2018 in connection with U.S. Appl. No. 14/988,191—10 pages.
Final Office Action issued by the USPTO dated Jan. 22, 2019 in connection with U.S. Appl. No. 14/988,191—8 pages.
Restriction Requirement dated May 15, 2015 for 14/2124,68, 8 pages.
Non-final Office Action dated Sep. 10, 2015 in connection with U.S. Appl. No. 14/212,468, 15 pages.
Final Office Action dated Mar. 1, 2016 in connection with U.S. Appl. No. 14/212,468, 20 pages.
Non-Final Office Action dated Mar. 20, 2017 in connection with U.S. Appl. No. 14/212,468, 20 pages.
Final Office Action dated Oct. 12, 2017 in connection with U.S. Appl. No. 14/212,468, 18 pages.
Non-Final Office Action dated Feb. 6, 2017 in connection with U.S. Appl. No. 15/199,179, 8 pages.
Restriction Requirement dated Mar. 14, 2016 for U.S. Appl. No. 14/920,664, 8 pages.
Non-final Office Action dated Sep. 14, 2016 in connection with U.S. Appl. No. 14/920,664, 7 pages.
Final Action dated Mar. 22, 2017 in connection with U.S. Appl. No. 14/920,664, 8 pages.
Non-Final Office Action dated Sep. 26, 2017 in connection with U.S. Appl. No. 14/920,664, 8 pages.
Examiner's Report dated Jan. 11, 2019 in connection with CA patent application No. 2,847,139—4 pages.
Extended Search Report dated Jul. 25, 2014 in connection with European Patent Application No. 14160032.0, 5 pages.
Office Action dated May 8, 2015 in connection with European Patent Application No. 14160032.0, 3 pages.
European Search report dated Nov. 21, 2018, in connection with European Patent Publication No. 3415205.
Examiner's Report dated Feb. 22, 2019 in connection with CA design application No. 184,226—1 page.
Examiner's Report dated Feb. 22, 2019 in connection with CA design application No. 175,917—2 pages.
Examiner's report dated Feb. 22, 2019 in connection with CA design application No. 171,235, 1 page.
Examiner's Report dated Feb. 22, 2019 in connection with CA design application No. 184,225—1 page.
Easton, Hockey Catalog 2000, Extracts of pp. 5, 6 and 7.
Mission holder called the driveshaft with a carbon insert—print out of web page from hockey world website—Jul. 13, 2015, 2 pages.
Mission Hockey catalog 1998 showing the driveshaft with carbon insert and the skate with the driveshaft, 3 pages.
Easton catalog 1999—composite blade holder, 5 pages.
Easton catalog 1998—composite blade holder, 7 pages.

* cited by examiner

ICE SKATE

FIELD

The invention generally relates to ice skates, including their blade holder and their blade.

BACKGROUND

An ice skate includes a skate boot for receiving a skater's foot and a blade holder connecting a blade to the skate boot. Many different types of skate boots, blade holders and blades have been developed in order to provide skates which can accommodate different skating maneuvers as well as to provide certain benefits to skaters.

As with most sports equipment, a visual appearance of a skate is an important consideration for a skater using it. For this reason, various efforts have been made which resulted in numerous skates with different designs of skate boots being available. However, variations in visual appearance of blade holders have been generally limited in comparison. For instance, while blade holders of different shapes have been developed (e.g., depending on different manufacturers), there has been little effort directed to other aesthetic aspects of the blade holders. Notably, conventional blade holders are typically in a single color, mostly white, and while some blade holders have implemented darker/shaded areas, these are generally limited to logos and/or other graphics that occupy very small areas.

For these and/or other reasons, there is a need to improve ice skates, including their blade holder.

SUMMARY

In accordance with various aspects of the invention, there is provided a blade holder for an ice skate. The ice skate comprises a skate boot for receiving a foot of a skater and a blade for contacting an ice surface. The blade holder comprises a blade-retaining base to retain the blade and a support extending upwardly from the blade-retaining base to interconnect the blade holder and the skate boot. A visual appearance of the blade holder may be designed such that the blade holder has visual characteristics enhancing its aesthetics and/or other aspects related to its visual appearance (e.g., an effect on the skater, a perception that others may have of the skater, elaborateness and/or customization of its visual appearance, etc.). For instance, selected parts of an exterior of the blade holder may be colored differently for aesthetic and/or other purposes.

For example, in accordance with an aspect of the invention, there is provided a blade holder for an ice skate. The ice skate comprises a skate boot for receiving a foot of a skater and a blade for contacting an ice surface. The blade holder comprises a blade-retaining base to retain the blade and a support extending upwardly from the blade-retaining base to interconnect the blade holder and the skate boot. At at least a majority of an exterior of the support is colored differently than at least a majority of an exterior of the blade-retaining base.

In accordance with another aspect of the invention, there is provided a blade holder for an ice skate. The ice skate comprises a skate boot for receiving a foot of a skater and a blade for contacting an ice surface. The blade holder comprises a blade-retaining base to retain the blade and a support extending upwardly from the blade-retaining base to interconnect the blade holder and the skate boot. A color of an exterior of the support that is at least predominant on the exterior of the support is different from a color of an exterior of the blade-retaining base that is at least predominant on the exterior of the blade-retaining base.

In accordance with another aspect of the invention, there is provided a blade holder for an ice skate. The ice skate comprises a skate boot for receiving a foot of a skater and a blade for contacting an ice surface. The blade holder comprises a blade-retaining base to retain the blade; a front pillar and a rear pillar that project upwardly from the blade-retaining base to interconnect the blade holder and the skate boot; and a void extending from the front pillar to the rear pillar. At least a majority of an exterior of the front pillar and at least a majority of an exterior of the rear pillar are colored differently than at least a majority of an exterior of the blade-retaining base.

In accordance with another aspect of the invention, there is provided a blade holder for an ice skate. The ice skate comprises a skate boot for receiving a foot of a skater and a blade for contacting an ice surface. The blade holder comprises a blade-retaining base to retain the blade; a front pillar and a rear pillar that project upwardly from the blade-retaining base to interconnect the blade holder and the skate boot; and a void extending from the front pillar to the rear pillar. A color of an exterior of the front pillar that is at least predominant on the exterior of the front pillar and a color of an exterior of the rear pillar that is at least predominant on the exterior of the rear pillar are different from a color of an exterior of the blade-retaining base that is at least predominant on the exterior of the blade-retaining base.

In accordance with another aspect of the invention, there is provided a blade holder for an ice skate. The ice skate comprises a skate boot for receiving a foot of a skater and a blade for contacting an ice surface. The blade holder comprises a blade-retaining base to retain the blade and a support extending upwardly from the blade-retaining base to interconnect the blade holder and the skate boot. The blade-retaining base comprises a first material and the support comprises a second material. The first material and the second material differ in stiffness and are colored differently.

In accordance with another aspect of the invention, there is provided a blade holder for an ice skate. The ice skate comprises a skate boot for receiving a foot of a skater and a blade for contacting an ice surface. The blade holder comprises a blade-retaining base to retain the blade and a support extending upwardly from the blade-retaining base to interconnect the blade holder and the skate boot. The blade-retaining base comprises a first material and the support comprises a second material different from the first material. The support comprises an overlay on the second material.

In accordance with another aspect of the invention, there is provided a blade holder for an ice skate. The ice skate comprises a skate boot for receiving a foot of a skater and a blade for contacting an ice surface. The blade holder comprises a blade-retaining base to retain the blade and a support extending upwardly from the blade-retaining base to interconnect the blade holder and the skate boot. An exterior of the blade holder comprises a checkered pattern and at least part of an exterior of the blade-retaining base is free of checkering.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the following drawings, in which.

Figure 1:
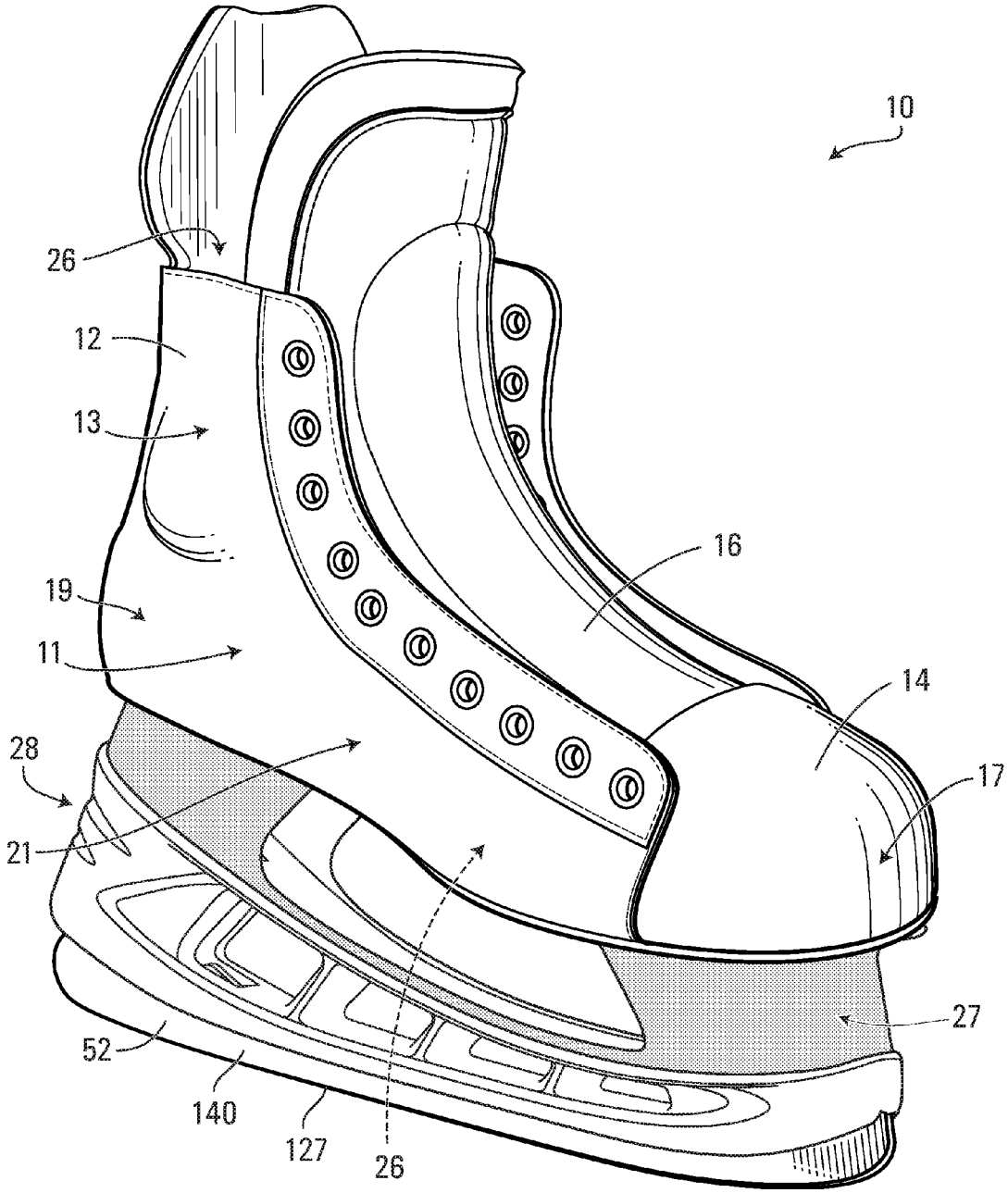
FIG. 1 is a perspective view of an example of an ice skate comprising a blade holder that includes an exterior comprising parts that are differently colored, in accordance with an embodiment of the invention.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION OF EMBODIMENTS

Figure 2:
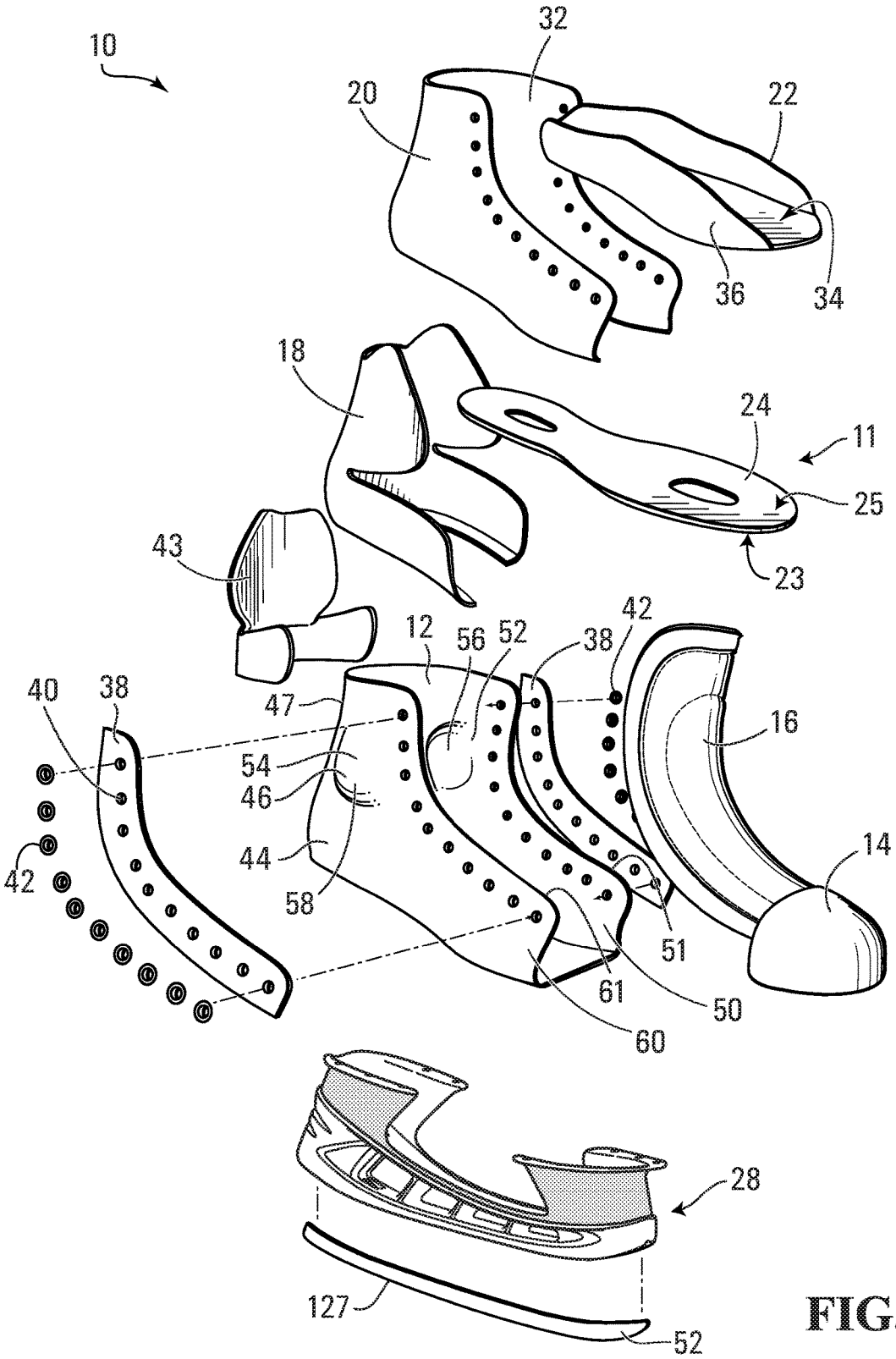
FIG. 2 is an exploded view of the ice skate, including a skate boot, the blade holder, and a blade.
Figure 3:
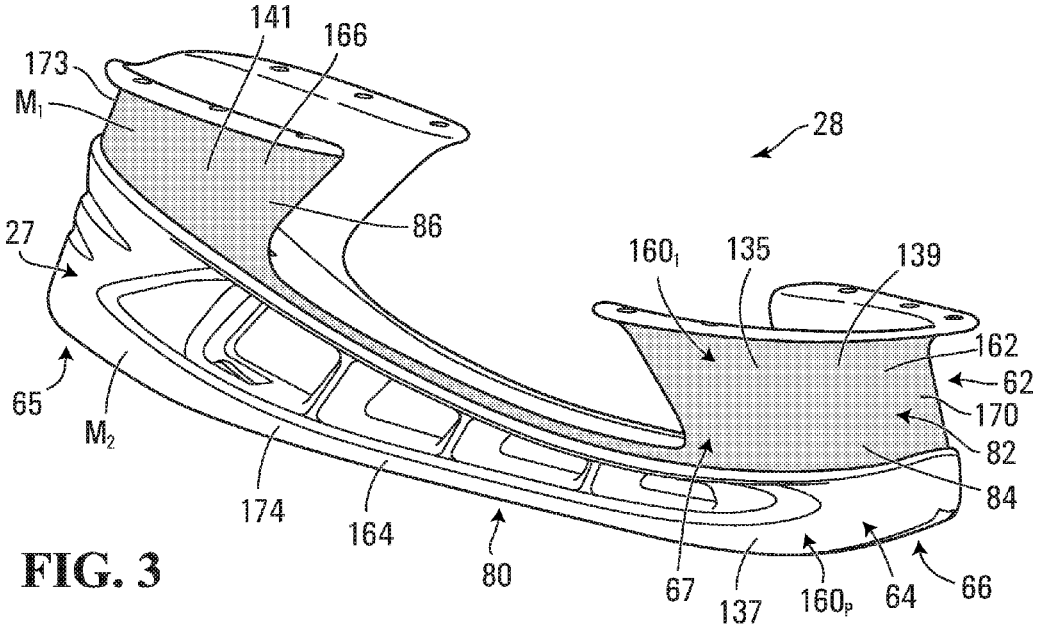
FIGS. 3 to 9 are various views of the blade holder.
Figure 4:
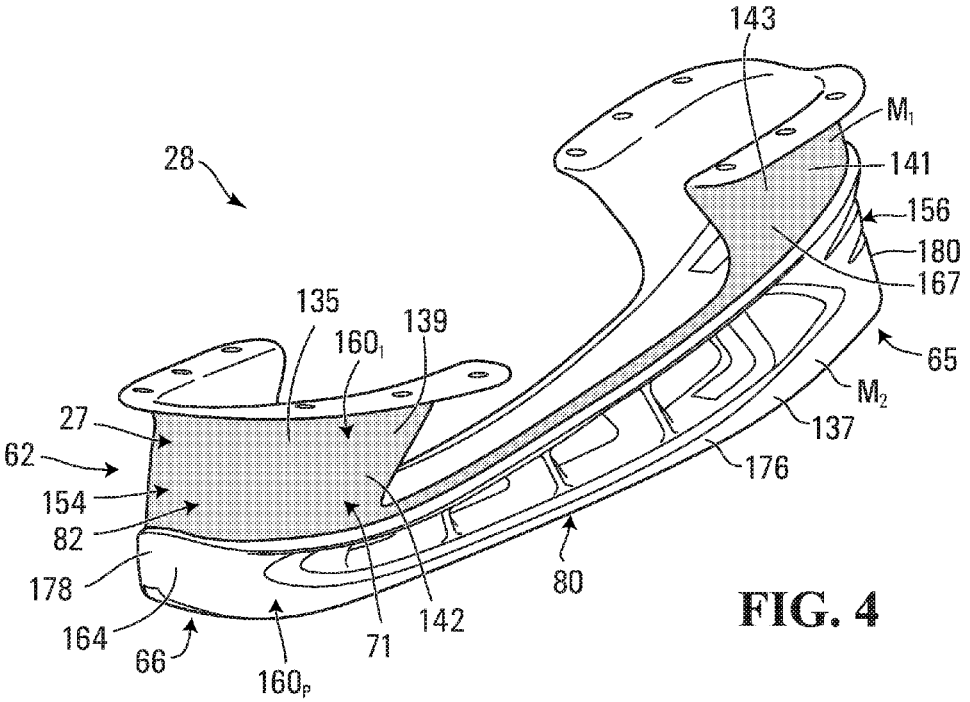

FIGS. 1 and 2 show an example of an ice skate 10 in accordance with an embodiment of the invention. The ice skate 10 comprises a skate boot 11 for enclosing a skater's foot, a blade holder 28, and a blade 52 for contacting an ice surface 5 on which the skater skates. In this embodiment, the ice skate 10 is a hockey skate designed for playing ice hockey. In other embodiments, the ice skate 10 may be designed for other types of skating activities.

As further discussed below, in this embodiment, a visual appearance of the blade holder 28 may be designed such that the blade holder 28 has visual characteristics enhancing its aesthetics and/or other aspects related to its visual appearance (e.g., an effect on the skater, elaborateness and/or customization of its visual appearance, etc.). In this embodiment, this is achieved while the blade holder 28 is lightweight and/or provides other performance benefits to the skater. For example, in this embodiment, selected parts of an exterior 27 of the blade holder 28 are colored differently for aesthetic and/or other purposes. Also, in this embodiment, the blade holder 28 is designed to optimize its weight and performance characteristics, including greater stiffness in certain areas (e.g., front and heel areas) and greater feel and control in other areas (e.g., along an interface with the blade 52). For instance, in this embodiment, the blade holder 28 comprises an arrangement of different materials (e.g., a composite material and a polymeric material) that differ in stiffness and density and are strategically distributed in the blade holder 28. These different materials are related to the selected parts of the exterior 27 of the blade holder 28 that are colored differently.

Figure 54:
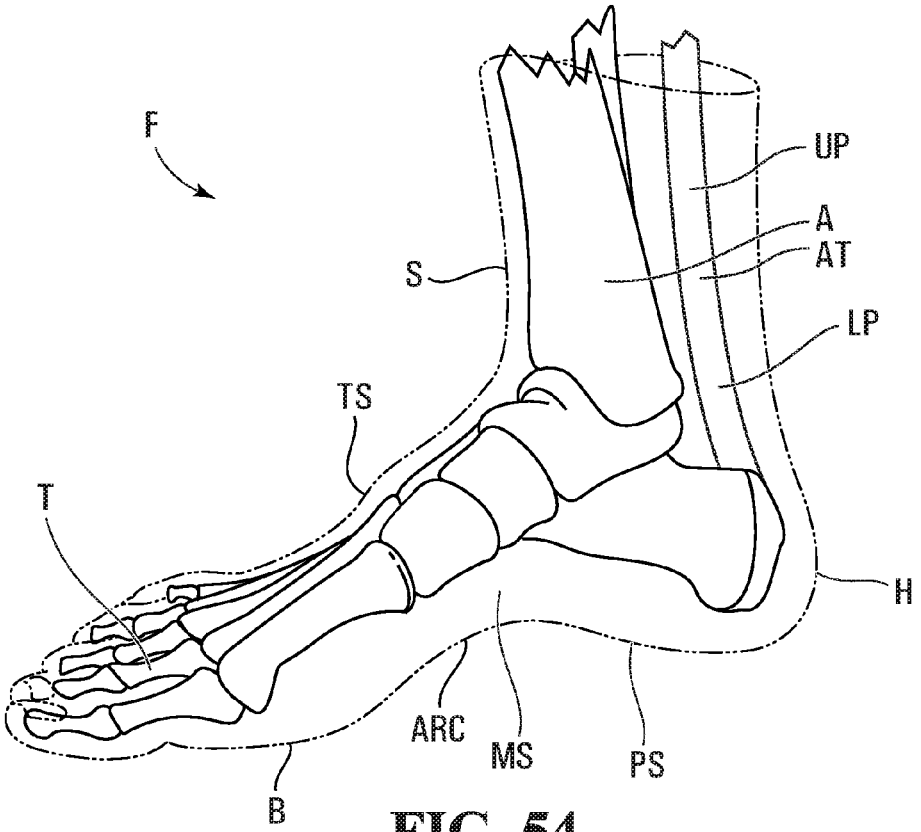
FIGS. 54 and 55 are side and front views of a right foot of the skater with an integument of the foot shown in dotted lines and bones shown in solid lines.
Figure 55:
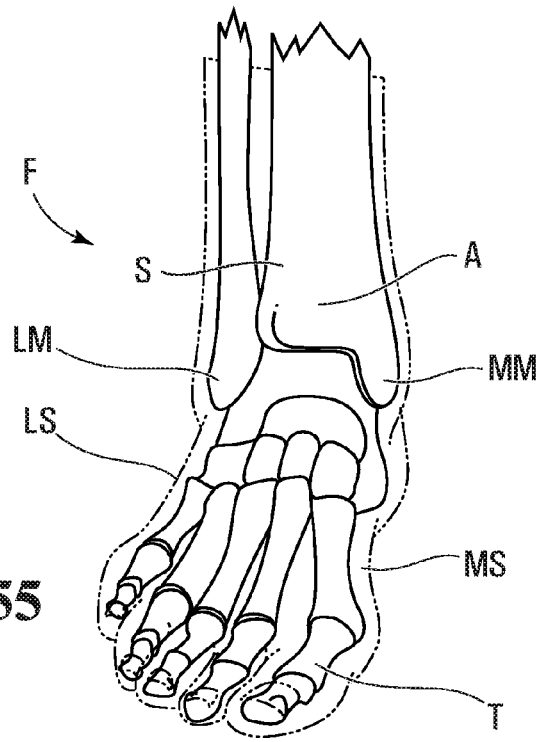

The skate boot 11 defines a cavity 26 for receiving the skater's foot. With additional reference to FIGS. 54 and 55, the skater's foot includes toes T, a ball B, an arch ARC, a plantar surface PS, a top surface TS, a medial side MS and a lateral side LS. The top surface TS of the skater's foot is continuous with a lower portion of the skater's shin S. In addition, the skater has a heel H, an Achilles tendon AT, and an ankle A having a medial malleolus MM and a lateral malleolus LM that is at a lower position than the medial malleolus MM. The Achilles tendon AT has an upper part UP and a lower part LP projecting outwardly with relation to the upper part UP and merging with the heel H. A forefoot of the skater includes the toes T and the ball B, a hindfoot of the skater includes the heel H, and a midfoot of the skater is between the forefoot and midfoot.

In this embodiment, the skate boot 11 comprises a front portion 17 for receiving the toes T of the skater's foot, a rear portion 19 for receiving the heel H of the skater's foot, and an intermediate portion 21 between the front portion 17 and the rear portion 19.

More particularly, in this embodiment, the skate boot 11 comprises an outer shell 12, a toe cap 14 for facing the toes T, a tongue 16 extending upwardly and rearwardly from the toe cap 14 for covering the top surface TS of the skater's foot, a rigid insert 18 for providing more rigidity around the ankle A and the heel H of the skater's foot, an inner lining 20, a footbed 22, and an insole 24. The skate boot 11 also comprises lace members 38 and eyelets 42 punched into the lace members 38, the outer shell 12 and the inner lining 20 vis-à-vis apertures 40 in order to receive laces for tying on the skate 10.

The inner lining 20 is affixed to an inner surface of the outer shell 12 and comprises an inner surface 32 intended for contact with the heel H and medial and lateral sides MS, LS of the skater's foot and the skater's ankle A in use. The inner lining 20 may be made of a soft material (e.g., a fabric made of NYLON® fibers or any other suitable fabric). The rigid insert 18 is sandwiched between the outer shell 12 and the inner lining 20 and may be affixed in any suitable way (e.g., glued to the inner surface of the outer shell 12 and stitched along its periphery to the outer shell 12). The footbed 22 is mounted inside the outer shell 12 and comprises an upper surface 34 for receiving the plantar surface PS of the skater's foot and a wall 36 projecting upwardly from the upper surface 34 to partially cup the heel H and extend up to a medial line of the skater's foot. The insole 24 has an upper surface 25 for facing the plantar surface PS of the skater's foot and a lower surface 23 on which the outer shell 12 may be affixed.

The outer shell 12 is molded (e.g., thermoformed) such that it comprises a heel portion 44 for receiving the heel H, an ankle portion 46 for receiving the ankle A, and medial and lateral side portions 50, 60 for facing the medial and lateral sides MS, LS of the skater's foot, respectively. The medial and lateral side portions 50, 60 include upper edges 51, 61 which connect to the lace members 38. The heel portion 44 may be formed such that it is substantially cup-shaped for following the contour of the heel H. The ankle portion 46 comprises medial and lateral ankle sides 52, 54. The medial ankle side 52 has a medial cup-shaped depression 56 for receiving the medial malleolus MM and the lateral ankle side 54 has a lateral cup-shaped depression 58 for receiving the lateral malleolus LM of the skater. The lateral depression 58 is located slightly lower than the medial depression 56, for conforming to the morphology of the skater's foot. The ankle portion 46 further comprises a rear portion 47 facing the lower part LP of the Achilles tendon AT. The rear portion 47 may be thermoformed such that it follows the lower part LP of the Achilles tendon AT. Furthermore, the skate boot 11 also includes a tendon guard 43 affixed to the rear portion 47 of the ankle portion 46 and extending upwardly therefrom.

The skate boot 11 may be constructed in any other suitable way in other embodiments. For example, in other embodiments, various components of the skate boot 11 mentioned above may be configured differently or omitted and/or the skate boot 11 may comprise any other components that may be made of any other suitable materials and/or using any other suitable processes.

With additional reference to FIGS. 3 to 8, the blade holder 28 comprises a lower portion 64 comprising a blade-retaining base 80 that retains the blade 52 and an upper portion 62 comprising a support 82 that extends upwardly from the blade-retaining base 80 towards the skate boot 11 to interconnect the blade holder 28 and the skate boot 11. A front portion 66 of the blade holder 28 and a rear portion 68 of the blade holder 28 define a longitudinal axis 65 of the blade holder 28. The front portion 66 of the blade holder 28 includes a front 154 of the blade holder 28 and extends beneath and along the skater's forefoot in use, while the rear portion 68 of the blade holder 28 includes a rear 156 of the blade holder 28 and extends beneath and along the skater's hindfoot in use. An intermediate portion 74 of the blade holder 28 is between the front and rear portions 66, 68 of the blade holder 28 and extends beneath and along the skater's midfoot in use. A length L of the blade holder 28 can be measured from a frontmost point 70 to a rearmost point 72 of the blade holder 28. The blade holder 28 comprises a medial side 71 and a lateral side 67 that are opposite one another. The blade holder 28 has a longitudinal direction (i.e., a direction generally parallel to its longitudinal axis 65) and transversal directions (i.e., directions transverse to its longitudinal axis 65), including a widthwise direction (i.e., a lateral direction generally perpendicular to its longitudinal axis 65). The blade holder 28 also has a height direction normal to its longitudinal and widthwise directions.

The blade-retaining base 80 is elongated in the longitudinal direction of the blade holder 28 and is configured to retain the blade 52 such that the blade 52 extends along a bottom portion 73 of the blade-retaining base 80 to contact the ice surface. To that end, the blade-retaining base 80 comprises a blade-retention portion 75 to face and retain the blade 52. In this embodiment, the blade-retention portion 75 comprises a recess 76 in which an upper portion of the blade 52 is disposed.

Figure 23A:
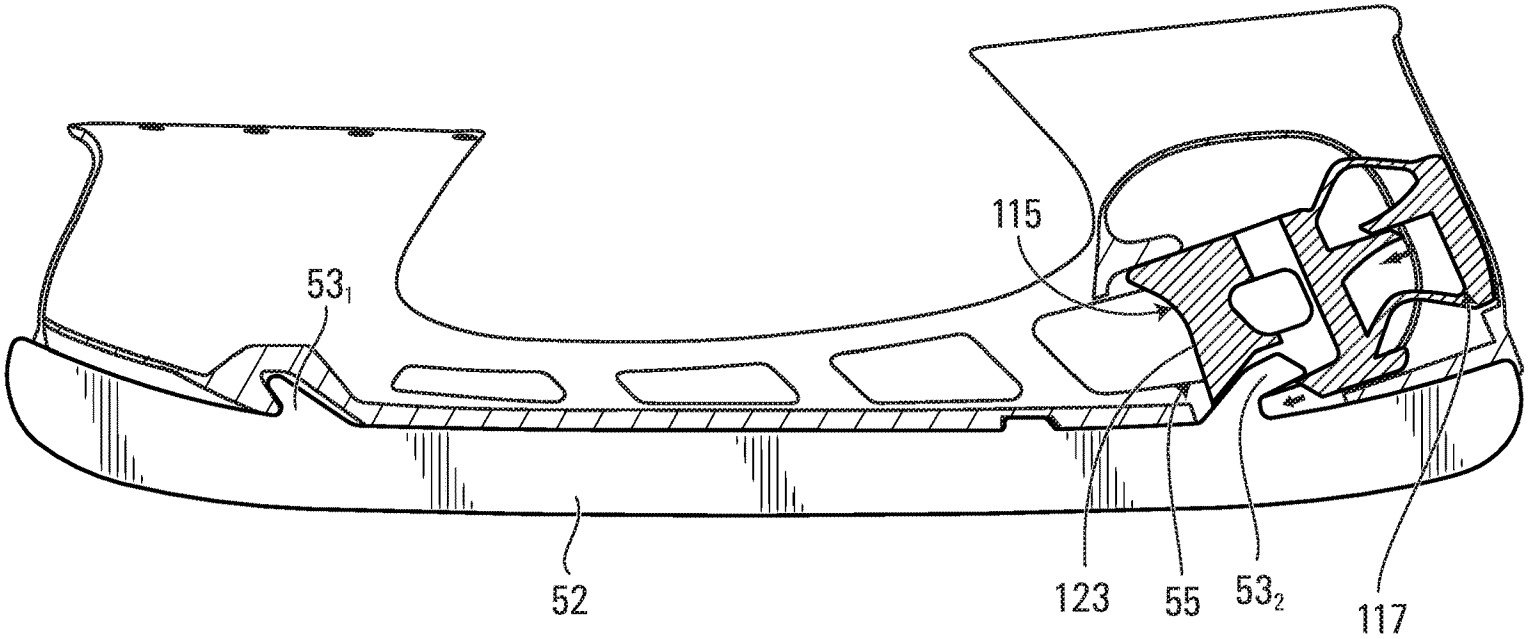
FIGS. 23A to 23C are partial cross-sectional views showing a blade-detachment mechanism of the blade holder.
Figure 23B:
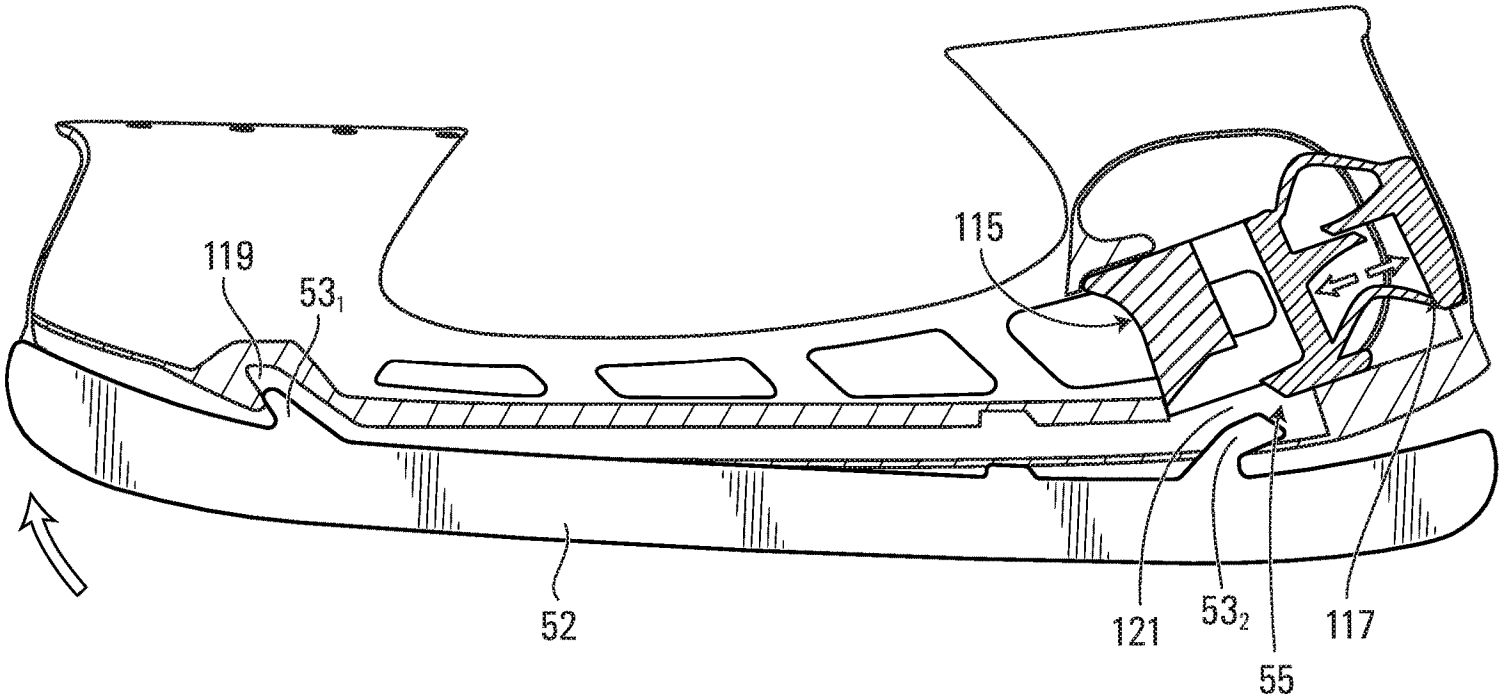
Figure 23C:
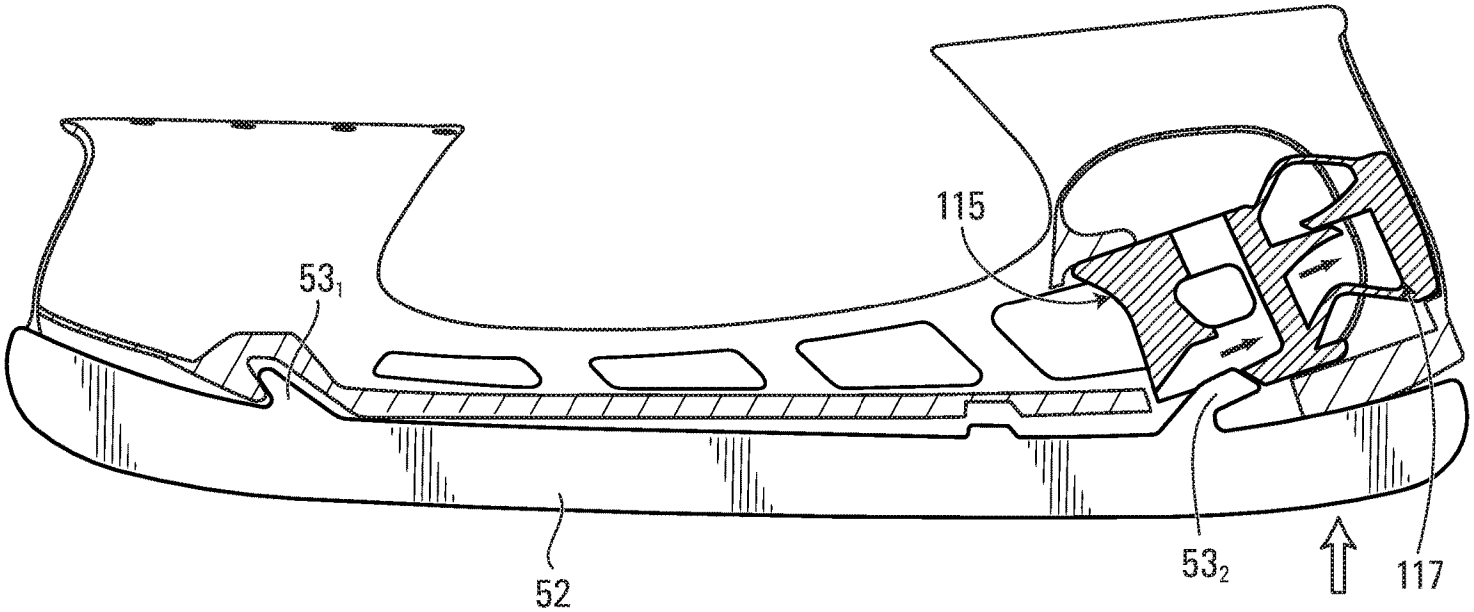
Figure 24:
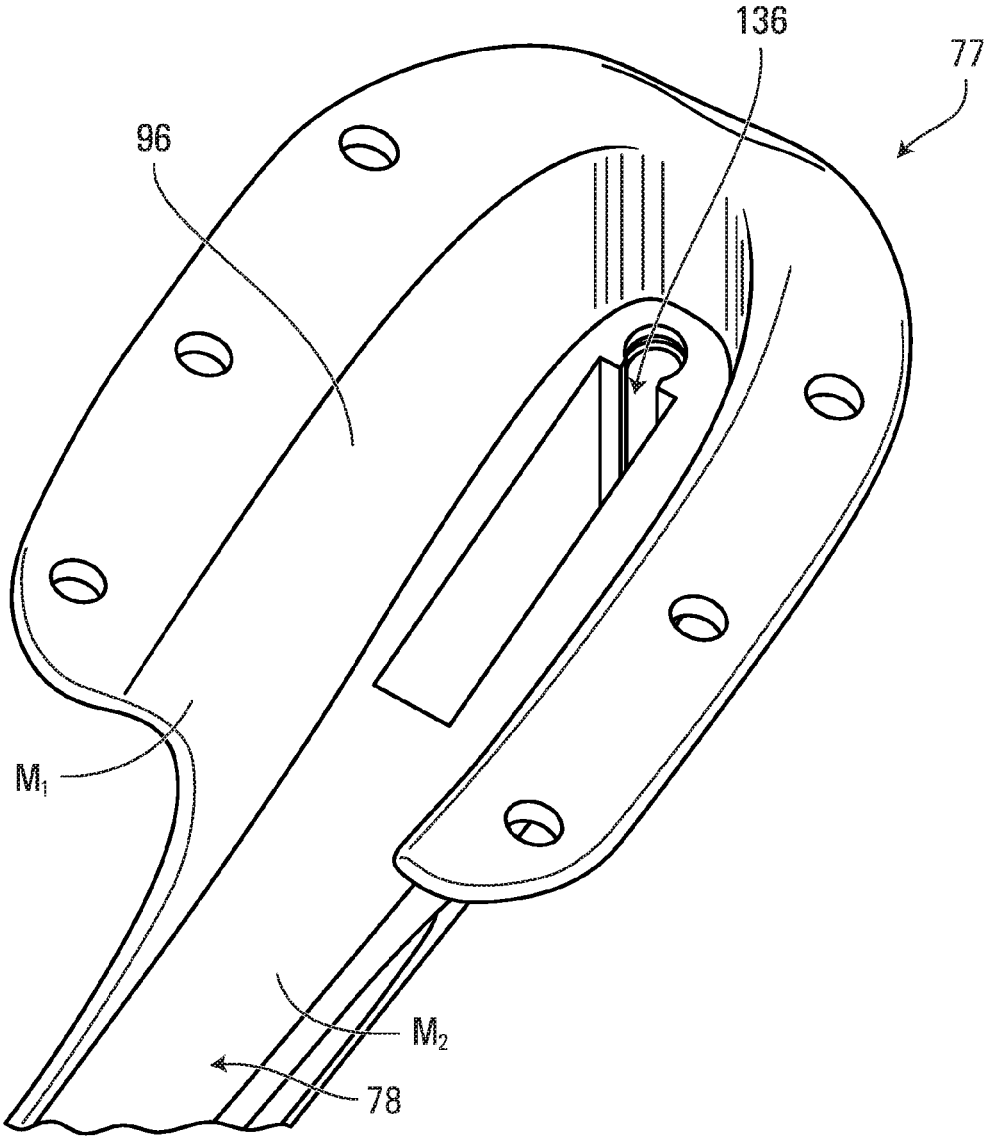
FIGS. 24 to 28 show various views of different parts of the blade holder, including an interconnection of these different parts of the blade holder.
Figure 25:
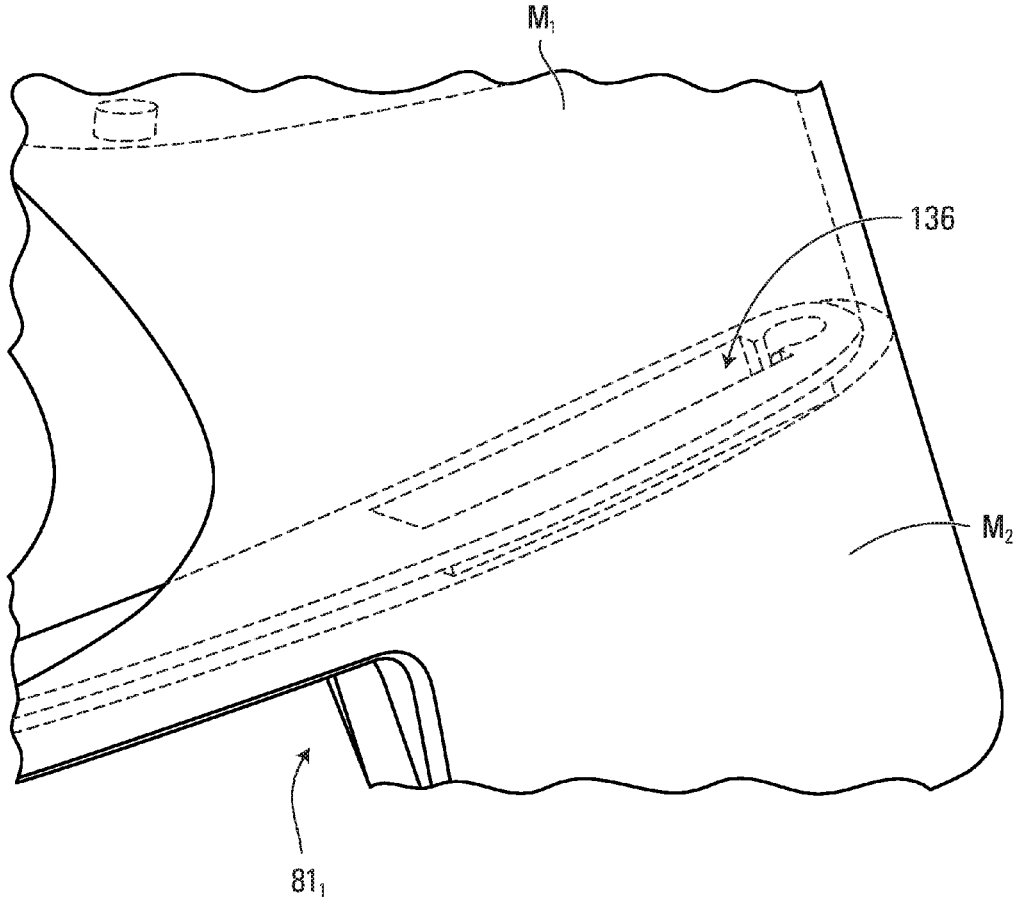
Figure 26:
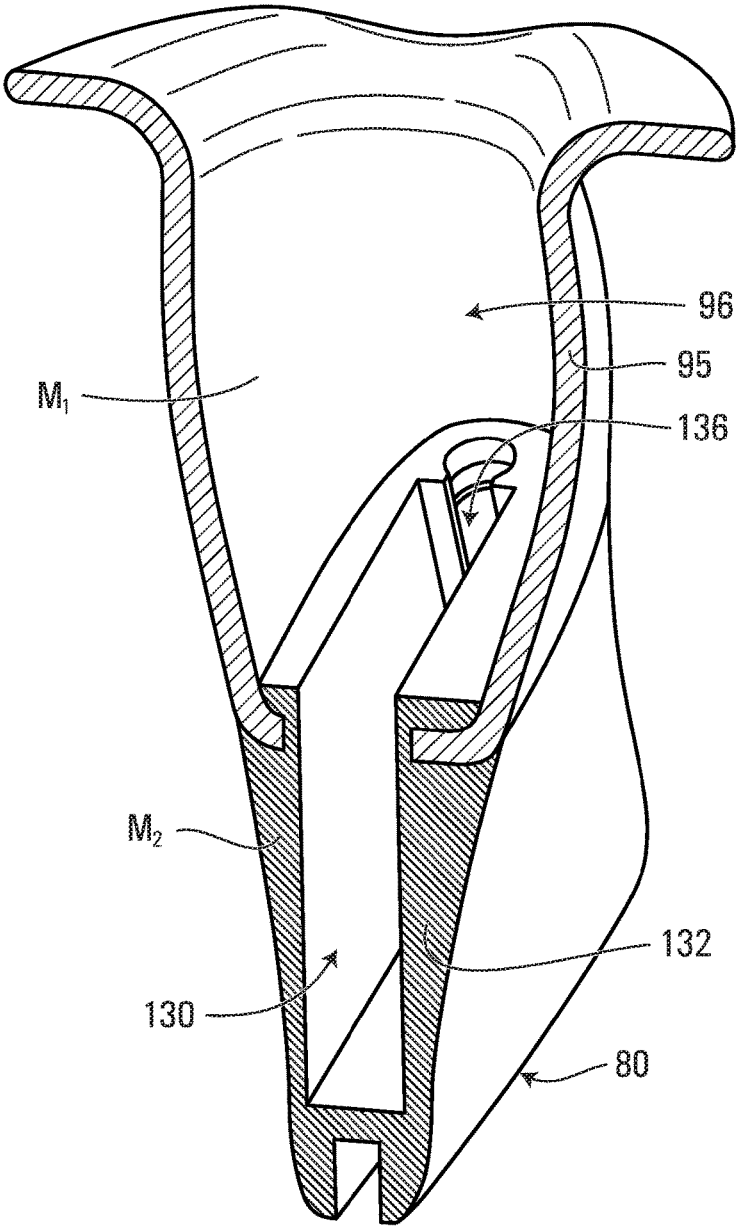
Figure 27:
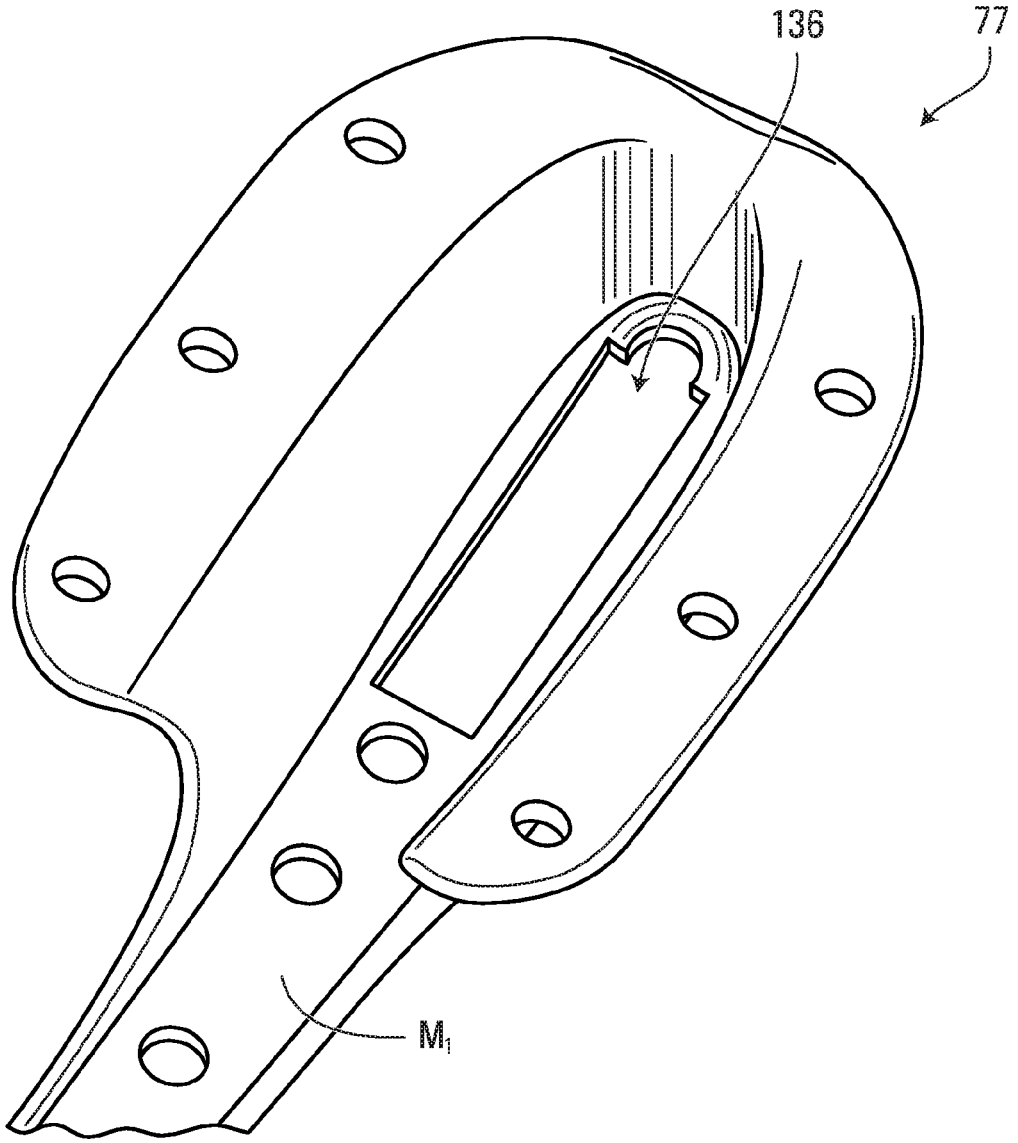

The blade holder 28 can retain the blade 52 in any suitable way. In this embodiment, with additional reference to FIGS. 23A to 23C, the blade holder 28 comprises a blade-detachment mechanism 55 such that the blade 52 is selectively detachable and removable from, and attachable to, the blade holder 28 (e.g., when the blade 52 is worn out or otherwise needs to be replaced or removed from the blade holder 28). More particularly, in this embodiment, the blade 52 includes a plurality of projections 531, 532. The blade-detachment mechanism 55 includes an actuator 115 and a biasing element 117 which biases the actuator 115 in a direction towards the front portion 66 of the blade holder 28. To attach the blade 52 to the blade holder 28, the front projection 531 is first positioned within a hollow space 119 (e.g., a recess or hole) of the blade holder 28. The rear projection 532 can then be pushed upwardly into a hollow space 121 (e.g., a recess or hole) of the blade holder 28, thereby causing the biasing element 117 to bend and the actuator 115 to move in a rearward direction. The rear projection 532 will eventually reach a position which will allow the biasing element 117 to force the actuator 115 towards the front portion 66 of the blade holder 28, thereby locking the blade 52 in place. The blade 52 can then be removed by pushing against a finger-actuating surface 123 of the actuator 115 to release the rear projection 532 from the hollow space 121 of the blade holder 28. Further information on examples of implementation of the blade-detachment mechanism 55 in some embodiments may be obtained from U.S. Pat. No. 8,454,030 hereby incorporated by reference herein. The blade-detachment mechanism 55 may be configured in any other suitable way in other embodiments.

In this embodiment, the blade-retaining base 80 comprises a plurality of apertures $\mathbf{81}_1$-$\mathbf{81}_4$ distributed in the longitudinal direction of the blade holder 28 and extending from the medial side 71 to the lateral side 67 of the blade holder 28. In this example, respective ones of the apertures $\mathbf{81}_1$-$\mathbf{81}_4$ differ in size. More particularly, in this example, the apertures $\mathbf{81}_1$-$\mathbf{81}_4$ decrease in size towards the front portion 66 of the blade holder 28. The apertures $\mathbf{81}_1$-$\mathbf{81}_4$ may have any other suitable configuration, or may be omitted, in other embodiments.

The blade-retaining base 80 may be configured in any other suitable way in other embodiments.

The support 82 is configured for supporting the skate boot 11 above the blade-retaining base 80 and transmit forces to and from the blade-retaining base 80 during skating. In this embodiment, the support 82 comprises a front pillar 84 and a rear pillar 86 which extend upwardly from the blade-retaining base 80 towards the skate boot 11. The front pillar 84 extends towards the front portion 17 of the skate boot 11 and the rear pillar 86 extends towards the rear portion 19 of the skate boot 11. The blade-retaining base 80 extends from the front pillar 84 to the rear pillar 86. More particularly, in this embodiment, the blade-retaining base 80 comprises a bridge 88 interconnecting the front and rear pillars 84, 86.

The support 82 and the skate boot 11 can be connected to one another in any suitable way. In this embodiment, the support 82 is affixed to the skate boot 11. More particularly, in this embodiment, the front and rear pillars 84, 86 are fastened to the skate boot 11 by fasteners (e.g., rivets, screws, bolts). In this example, each of the front and rear pillars 84, 86 comprises a flange 87 including a plurality of apertures $\mathbf{89}_1$-$\mathbf{89}_F$ to receive respective ones of the fasteners that fasten the blade holder 28 to the skate boot 11. The support 82 may be affixed to the skate boot 11 in any other suitable manner in other embodiments (e.g., by an adhesive).

The support 82 may be configured in any other suitable way in other embodiments.

The visual appearance of the blade holder 28 may be designed to enhance its aesthetics and/or other aspects related to its visual appearance. Notably, in this embodiment, substantial parts $160_1$-$160_P$ of the exterior 27 of the blade holder 28 are colored differently for aesthetic and/or other purposes. In that sense, with the substantial parts $160_1$-$160_P$ of its exterior 27 being chromatically different, the blade holder 28 may be referred to as being a "polychromatic" blade holder.

The exterior 27 of the blade holder 28 is that outer part (e.g., surface) of the blade holder 28 that is visible and faces outwardly away from the blade holder 28. It comprises the medial side 71, the lateral side 67, the front 154, and the rear 156 of the blade holder 28. Thus, the exterior 27 of the blade holder 28 includes an exterior 162 of the support 82 and an exterior 164 of the blade-retaining base 80, which are respectively that outer part (e.g., surface) of the support 82 that is visible and faces outwardly away from the support 82 and that outer part (e.g., surface) of the blade-retaining base 80 that is visible and faces outwardly away from the blade-retaining base 80. The exterior 162 of the support 82 comprises a lateral side 166, a medial side 167, a front 170, and a rear 173 of the support 82, while the exterior 164 of the blade-retaining base 80 comprises a lateral side 174, a medial side 176, a front 178, and a rear 180 of the blade-retaining base 80.

More particularly, in this embodiment, the exterior 162 of the support 82 and the exterior 164 of the blade-retaining base 80 are at least mainly (i.e., mainly or entirely) colored differently. That is, at least a main part (i.e., a main part or an entirety) of the exterior 162 of the support 82 and at least a main part of the exterior 164 of the blade-retaining base 80 exhibit different colors. Any suitable colors may be used, such as, for example: white, black, and gray, which are considered colors herein; red, blue, yellow, etc.; and any shade thereof.

The different colors exhibited by the exterior 162 of the support 82 and the exterior 164 of the blade-retaining base 80 may be arranged in any suitable way. In this embodiment, a relatively lighter portion of the exterior 27 of the blade holder 28 (i.e., exhibiting one or more lighter colors such as white or whitish shades) may be significant, whereas a relatively darker portion of the exterior 27 of the blade holder 28 (i.e., exhibiting one or more darker colors such as gray, black, red, blue or darker shades) may be more limited or less noticeable by the skater while skating. In some cases, this may be desirable as blade holders which are too dark have sometimes been less appreciated by skaters who may be perceived by others as skating slower when wearing blade holders which are too dark and/or who may sometimes feel that this affects their performance, such as by apparently making them believe or feel that they skate slower.

In this embodiment, at least a majority (i.e., a majority or the entirety) of the exterior 162 of the support 82 is colored differently than at least a majority of the exterior 164 of the blade-retaining base 80.

For instance, in some embodiments, at least 75%, in some cases at least 90%, and in some cases substantially an entirety of the exterior 162 of the support 82 may be colored differently than at least 75% of the exterior 164 of the blade-retaining base 80.

In some embodiments, at least the majority of the exterior 162 of the support 82 may be darker than at least the majority of the exterior 164 of the blade-retaining base 80. In other words, at least a majority of the exterior 162 of the support 82 may contrast at least the majority of the exterior 164 of the blade-retaining base 80. For example, a color 135 of the exterior 162 of the support 82 that is at least predominant (i.e., a predominant or sole color) on the exterior 162 of the support 82 may be different from a color 137 of the exterior 164 of the blade-retaining base 80 that is at least predominant on the exterior 164 of the blade-retaining base 80. Notably, in some cases, the color 135 of the exterior 162 of the support 82 that is at least predominant on the exterior 162 of the support 82 may be darker than the color 137 of the exterior 164 of the blade-retaining base 80 that is at least predominant on the exterior 164 of the blade-retaining base 80.

As such, a sole or main color 135 of the exterior 162 of the support 82 may be different from a sole or main color 137 of the exterior 164 of the blade-retaining base 80. For example, the sole or main color 135 of the exterior 162 of the support 82 may be darker than the sole or main 137 color of the exterior 164 of the blade-retaining base 80.

In this example, the exterior 162 of the support 82 includes an exterior 139 of the front pillar 84 and an exterior 141 of the rear pillar 86. In some cases, at least a majority of the exterior 139 of the front pillar 84 and at least a majority of the exterior 141 of the rear pillar 84 may be colored differently than at least the majority of the exterior 164 of the blade-retaining base 80; in some cases, at least 75% of the exterior 139 of the front pillar 84 and at least 75% of the exterior 141 of the rear pillar 86 may be colored differently than at least 75% of the exterior 164 of the blade-retaining base 80; in some cases, at least 90% of the exterior 139 of the front pillar 84 and at least 90% of the exterior 141 of the rear pillar 86 may be colored differently than at least 90% of the exterior 164 of the blade-retaining base 80; and in some cases, substantially an entirety of the exterior 139 of the front pillar 84 and substantially an entirety of the exterior 141 of the rear pillar 86 may be colored differently than substantially an entirety of the exterior 164 of the blade-retaining base 80. For instance, in some examples of implementation, at least the majority of the exterior 139 of the front pillar 84 and at least the majority of the exterior 141 of the rear pillar 86 may be darker than at least the majority of the exterior 164 of the blade-retaining base 80.

In some embodiments, a color 142 of the exterior 139 of the front pillar 84 that is at least predominant on the exterior 139 of the front pillar 84 and a color 143 of the exterior 141 of the rear pillar 86 that is at least predominant on the exterior 141 of the rear pillar 86 may be different from the color 137 of the exterior 164 of the blade-retaining base 80 that is at least predominant on the exterior 164 of the blade-retaining base 80. For example, the color 142 of the exterior 139 of the front pillar 84 and the color 143 of the exterior 141 of the rear pillar 86 may be darker than the color 137 of the exterior 164 of the blade-retaining base 80.

Moreover, in some embodiments, a sole or main color 142 of the exterior 139 of the front pillar 84 and a sole of main color 143 of the exterior 141 of the rear pillar 86 may be different from the sole or main color 137 of the exterior 164 of the blade-retaining base 80. For example, the sole or main color 142 of the exterior 139 of the front pillar 84 and the sole or main color 143 of the exterior 141 of the rear pillar 86 may be darker than the sole or main color 137 of the exterior 164 of the blade-retaining base 80.

Figure 22:
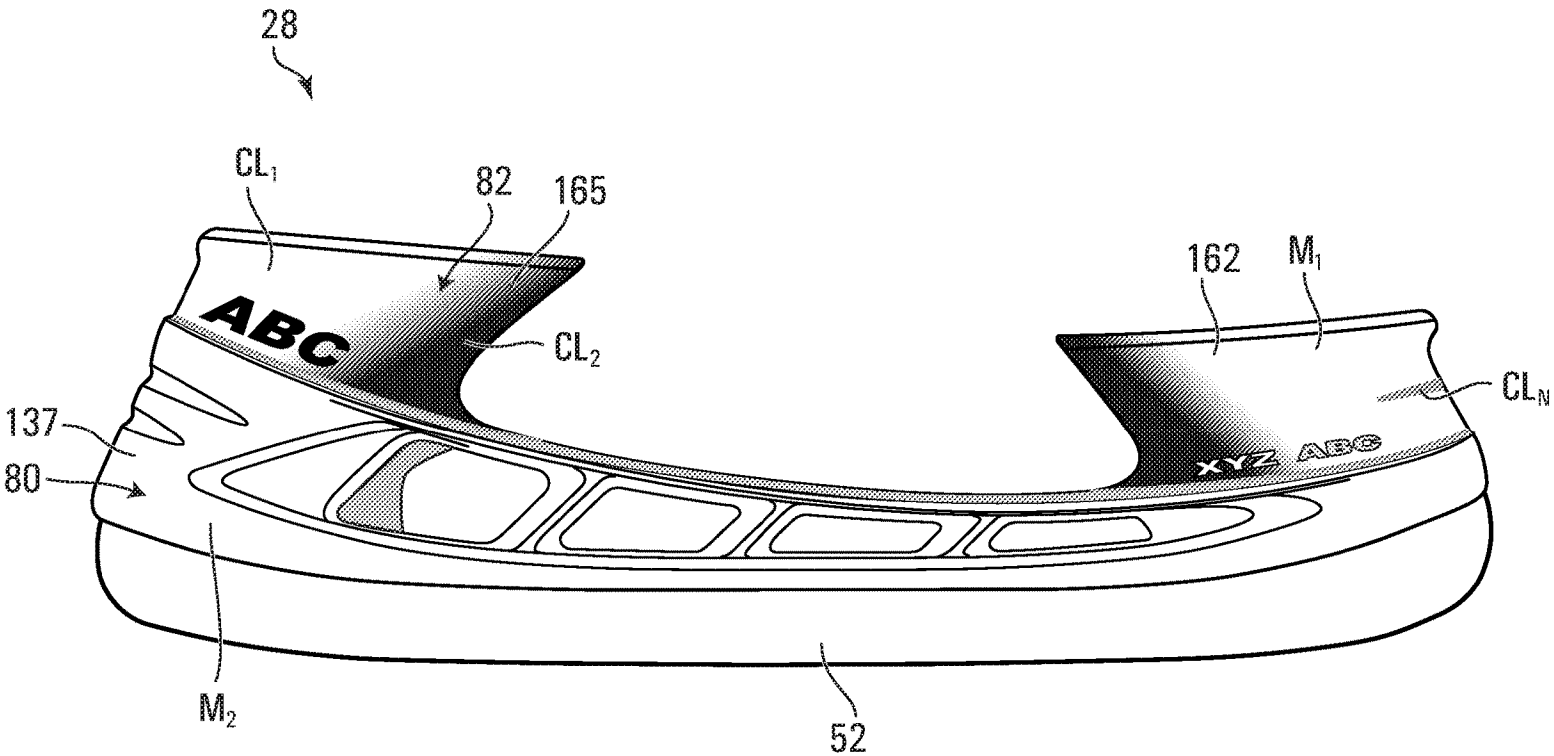
FIG. 22 shows an example of an embodiment in which an exterior of a support of the blade holder of FIGS. 3 to 9 has a plurality of colors.

In some embodiments, as shown in FIG. 22, the exterior 162 of the support 82 may have a plurality of colors $CL_1$-$CL_N$. Moreover, the exterior 162 of the support 82 may have more colors $CL_1$-$CL_N$ than the exterior 164 of the blade-retaining base 80. For example, in some cases, the colors $CL_1$-$CL_N$ of the exterior 162 of the support 82 may include at least two colors, in some cases at least three colors, in some cases at least four colors, and in some cases even more colors. Although in this embodiment, the exterior 164 of the blade-retaining base 80 is illustrated as having a single color 137, the exterior 164 of the blade-retaining base 80 may have a plurality of colors.

Moreover, in some embodiments, the exterior 162 of the support 82 may exhibit a gradual variation between respective ones of its colors $CL_1$-$CL_N$. That is, a transition region 165 may exist between the different colors $CL_1$-$CL_N$ of the exterior 162 of the support 82 where a given one of the colors $CL_1$-$CL_N$ of the exterior 162 of the support 82 gradually (i.e., rather than abruptly) changes into another of the colors $CL_1$-$CL_N$ of the exterior 162 of the support 82.

In some embodiments, an interface 105 of the different colors of the support 82 and the blade-retaining base 80 may extend over at least a substantial part of the length L of the blade holder 28. That is, the interface 105 between one or more of the colors $CL_1$-$CL_N$ of the exterior 162 of the support 82 and the color 137 (or the plurality of colors) of the blade-retaining base 80 may extend longitudinally along a significant portion of the length L of the blade holder 28. For instance, in some cases the interface 105 of different colors of the support 82 and the blade-retaining base 80 may extend over at least 20% of the length L of the blade holder 28, in some cases over at least 30% of the length L of the blade holder 28, in some cases over at least a majority of the length L of the blade holder 28, and in some cases even more.

In this embodiment, the blade holder 28 is characterized by a material distribution profile to optimize its weight and performance characteristics. Notably, in this embodiment, the material distribution profile of the blade holder 28 results in a variation in density and a variation in rigidity across certain areas of the blade holder 28 to reduce its weight while providing greater stiffness in some areas (e.g., the front and rear pillars 84, 86) where more rigidity may be desirable (e.g., to better transmit forces) and greater compliance (i.e., less stiffness) in other areas (e.g., along the blade-retaining base 80) where less rigidity may be desirable (e.g., for better feel and control). In this example, the material distribution profile of the blade holder 28 is used to provide the substantial parts $\mathbf{160}_1$-$\mathbf{160}_P$ of its exterior 27 that are differently colored.

The material distribution profile is designed such that the blade holder 28 comprises an arrangement of different materials $M_1$, $M_2$ disposed in selected areas of the blade holder 28. The different materials $M_1$, $M_2$ belong to different classes of materials (i.e., polymers, metals, ceramics and composites) and/or exhibit substantially different values of a given material property (e.g., modulus of elasticity, tensile strength, density, etc.).

In this embodiment, the material $M_1$ is stiffer (i.e., more rigid) than the material $M_2$ and makes up at least a major part (i.e., a major part or an entirety) of the support 82 of the upper portion 62 of the blade holder 28, while the material $M_2$ makes up at least a major part of the blade-retaining base 80 of the lower portion 64 of the blade holder 28. More particularly, in this embodiment, the material $M_1$ makes up at least a major part of each of the front and rear pillars 84, 86 and the material $M_2$ makes up at least a major part of the blade-retaining base 80. This makes the front and rear pillars 84, 86 of the blade holder 28 stiffer, which may better transmit forces and provide more strength during skating, while making the blade-retaining base 80 less stiff, which may allow for better feel and control during skating.

More particularly, in this embodiment, with additional reference to FIGS. 10 to 21, each of the front and rear pillars 84, 86 is at least mainly (i.e., mainly or entirely) made of the material $M_1$, while the blade-retaining base 80 is at least mainly made of the material $M_2$. In this example, each of the front and rear pillars 84, 86 is entirely made of the material $M_1$, while a major part 63 of the blade-retaining base 80 is made of the material $M_2$ and a thin upper part 69 of the bridge 88 of the blade-retaining base 80 is made of the material $M_1$ (i.e., at least a majority of the bridge 88 is made of the material $M_2$). More specifically, in this example, the thin upper part 69 of the bridge 88 of the blade-retaining base 80 is integrally formed and continuous with the front and rear pillars 84, 86 such that the thin upper part 69 of the bridge 88 and the front and rear pillars 84, 86 constitute a monolithic one-piece upper component 77 of the blade holder 28 that is made of the material $M_1$, while the major part 63 of the blade-retaining base 80 constitutes a monolithic one-piece lower component 78 of the blade holder 28 that is made of the material $M_2$. In other embodiments, different parts of the front and rear pillars 84, 86 and the blade-retaining base 80 may be made of the materials $M_1$, $M_2$.

The materials $M_1$, $M_2$ may differ in rigidity to any suitable degree. For example, in some embodiments, a ratio $\lambda_1/\lambda_2$ of a modulus of elasticity $\lambda_1$ (e.g., tensile modulus) of the material $M_1$ over a modulus of elasticity $\lambda_2$ of the material $M_2$ may be at least 2, in some cases at least 5, in some cases at least 10, in some cases at least 20, in some cases at least 50, and in some cases even more (e.g., at least 100). This ratio may have any other suitable value in other embodiments.

For instance, in some embodiments, the modulus of elasticity $\lambda_1$ of the material $M_1$ may be at least 25 GPa, in some cases at least 50 GPa, in some cases at least 100 GPa, and in some cases even more (e.g., at least 150 GPa or 200 GPa), and/or the modulus of elasticity $\lambda_2$ of the material $M_2$ may be no more than 20 GPa, in some cases no more than 10 GPa, in some cases no more than 5 GPa, and in some cases even less (e.g., no more than 2 GPa or 1 GPa). The modulus of elasticity $\lambda_1$ of the material $M_1$ and/or the modulus of elasticity $\lambda_2$ of the material $M_2$ may have any other suitable value in other embodiments.

In this embodiment, the material $M_1$ is denser than the material $M_2$ and, thus, in addition to making the blade-retaining base 80 less stiff for better feel and control, the material $M_2$ which is less dense than the material $M_1$ helps to reduce the weight of the blade holder 28.

The materials $M_1$, $M_2$ may differ in density to any suitable degree. For example, in some embodiments, a ratio $\rho_1/\rho_2$ of a density $\rho_1$ of the material $M_1$ over a density $\rho_2$ of the material $M_2$ may be at least 1.1, in some cases at least 1.2, in some cases at least 1.3, and in some cases even more (e.g., at least 1.5). This ratio may have any other suitable value in other embodiments.

For instance, in some embodiments, the density $\rho_1$ of the material $M_1$ may be at least 1 g/cm$^3$, in some cases at least 1.2 g/cm$^3$, in some cases at least 1.4 g/cm$^3$, in some cases at least 1.8 g/cm$^3$, in some cases at least 2 g/cm$^3$, and in some cases even more (e.g., at least 2.5 g/cm$^3$ or 3 g/cm$^3$), and/or the density $\rho_2$ of the material $M_2$ may be no more than 2 g/cm$^3$, in some cases no more than 1.8 g/cm$^3$, in some cases no more than 1.4 g/cm$^3$, in some cases no more than 1.2 g/cm$^3$ and in some cases even less (e.g., no more than 1 g/cm$^3$ or 0.8 g/cm$^3$). The density $\rho_1$ of the material $M_1$ and/or the density $\rho_2$ of the material $M_2$ may have any other suitable value in other embodiments.

Moreover, in some embodiments, the materials $M_1$, $M_2$ may also be visually contrasting. For instance, in this embodiment, a color of the material $M_1$ may be different from a color of the material $M_2$. As such, the substantial parts $160_1$-$160_P$ of the exterior 27 of the blade holder 28 that are colored differently may be provided by the choice of materials $M_1$, $M_2$ used for the support 82 and the blade-retaining base 80. For example, the color of the material $M_1$ may be darker than the color of the material $M_2$.

In this embodiment, the material $M_1$ is a composite material and the material $M_2$ is a non-composite material (i.e., a material that is not a composite material). In this example, the non-composite material $M_2$ is a non-composite polymeric material.

More particularly, in this embodiment, the composite material $M_1$ is a fiber-matrix composite material that comprises a matrix 90 in which fibers $92_1$-$92_F$ are embedded.

The matrix 90 may include any suitable substance. In this embodiment, the matrix 90 is a polymeric matrix. Thus, in this example of implementation, the composite material $M_1$ is a fiber-reinforced plastic (FRP—a.k.a., fiber-reinforced polymer). The polymeric matrix 90 may include any suitable polymeric resin. For instance, in some examples, the polymeric matrix 90 may include a thermoplastic or thermosetting resin, such as epoxy, polyethylene, polypropylene, acrylic, thermoplastic polyurethane (TPU), polyether ether ketone (PEEK) or other polyaryletherketone (PAEK), polyethylene terephthalate (PET), polyvinyl chloride (PVC), poly(methyl methacrylate) (PMMA), polycarbonate, acrylonitrile butadiene styrene (ABS), nylon, polyimide, polysulfone, polyamide-imide, self-reinforcing polyphenylene, polyester, vinyl ester, vinyl ether, polyurethane, cyanate ester, phenolic resin, etc., a hybrid thermosetting-thermoplastic resin, or any other suitable resin. In this embodiment, the polymeric matrix 90 includes an epoxy resin.

The fibers $92_1$-$92_F$ may be made of any suitable material. In this embodiment, the fibers $92_1$-$92_F$ are carbon fibers. The composite material $M_1$ is thus a carbon-fiber-reinforced plastic in this example of implementation. Any other suitable type of fibers may be used in other embodiments (e.g., polymeric fibers such as aramid fibers (e.g., Kevlar fibers), boron fibers, silicon carbide fibers, metallic fibers, glass fibers, ceramic fibers, etc.).

In this embodiment, the fibers $92_1$-$92_F$ are continuous such that they constitute a continuous fiber reinforcement of the composite material $M_1$. For example, in this embodiment, the fibers $92_1$-$92_F$ may be provided as layers of continuous fibers (e.g. pre-preg (i.e., pre-impregnated) layers of fibers held together by an amount of matrix material, which is destined to provide a respective portion of the matrix 90 of the composite material $M_1$).

In this example, respective ones of the fibers $92_1$-$92_F$ are oriented differently. For example, in some embodiments, the fibers $92_1$-$92_F$ are arranged in layers stacked upon one another and may extend parallel or at an oblique angle to the longitudinal axis of the blade holder 28. For instance, given ones of the fibers $92_1$-$92_F$ in the layers that are stacked may be oriented at 0°, +/−45° and +/−90° in an alternating manner. The fibers $92_1$-$92_F$ may be arranged in any other suitable way in other examples.

In this embodiment, the polymeric material $M_2$ is a thermoplastic material. More particularly, in this example, the polymeric material $M_2$ is nylon (polyamide). The polymeric material $M_2$ may be any other suitable thermoplastic material in other examples (e.g., thermoplastic polyurethane (TPU), acrylonitrile butadiene styrene (ABS), etc.). The polymeric material $M_2$ may be a thermosetting material or any other suitable polymer in other embodiments (e.g., polypropylene, polyethylene (e.g., HDPE), polycarbonate, etc.).

Figure 5:
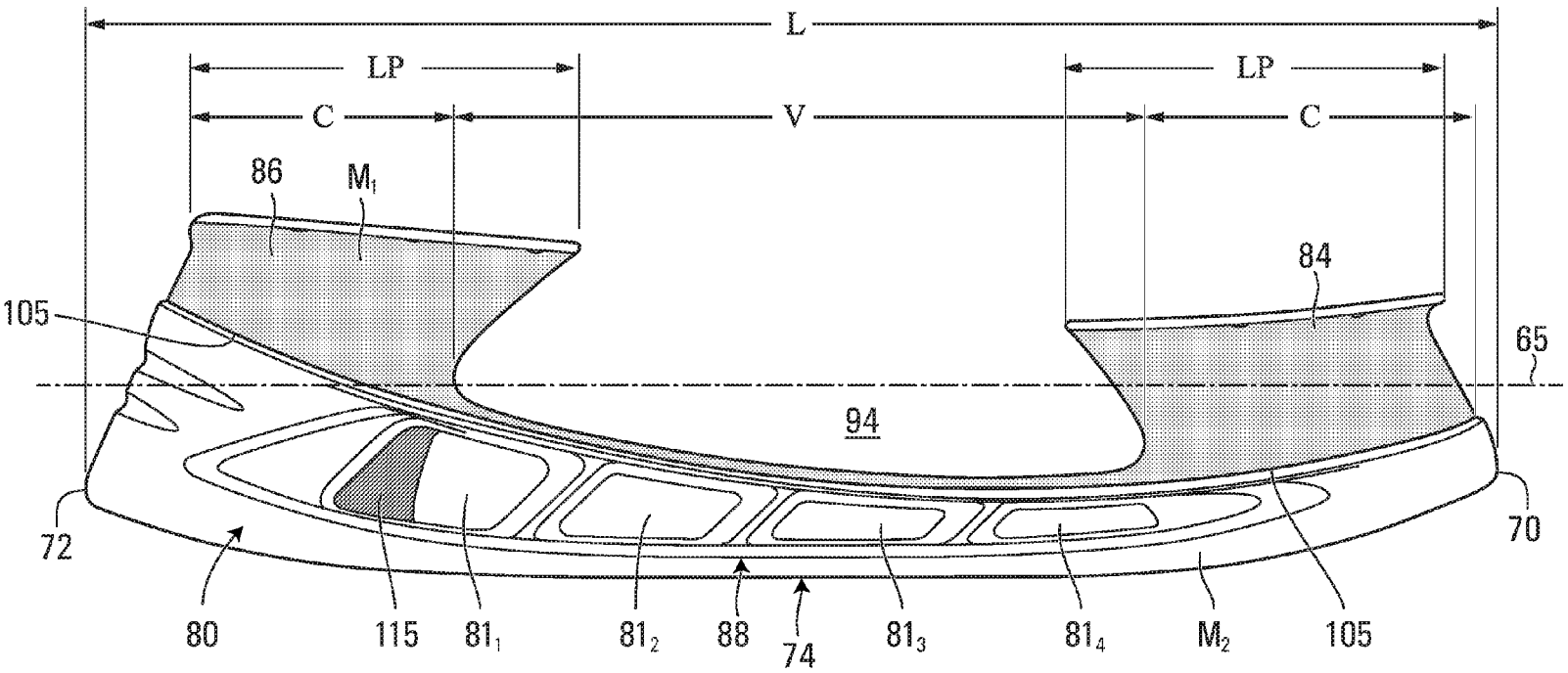
Figure 6:
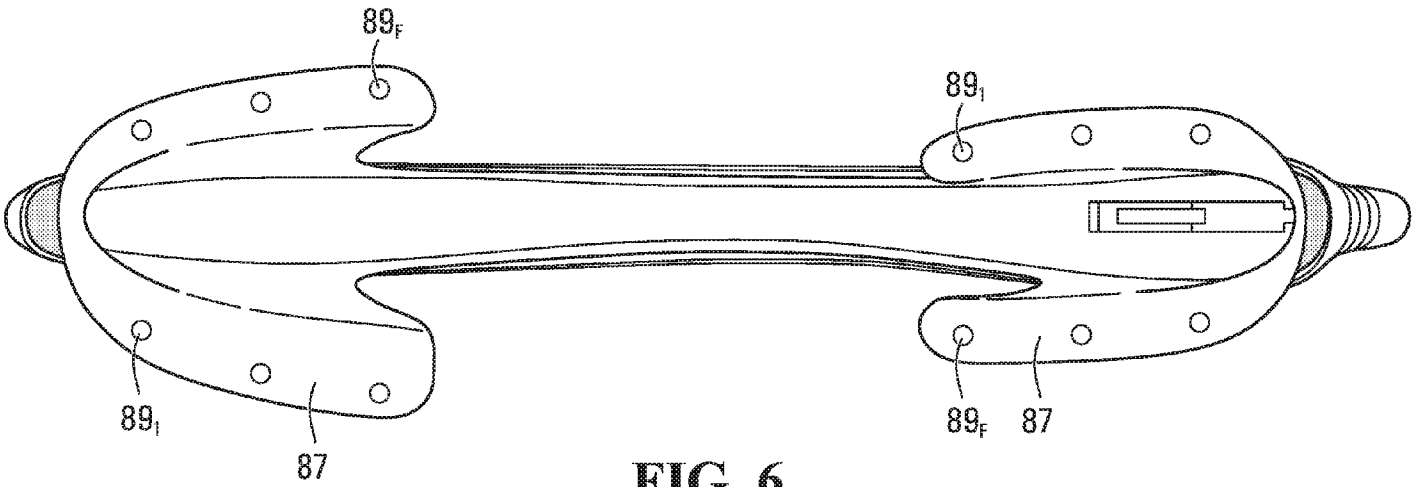
Figure 7:
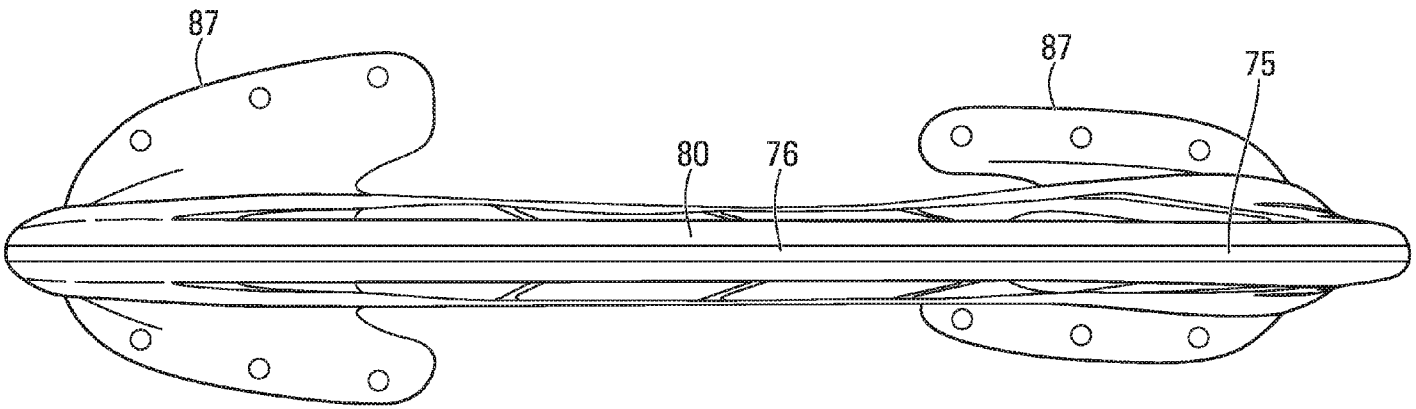
Figure 8:
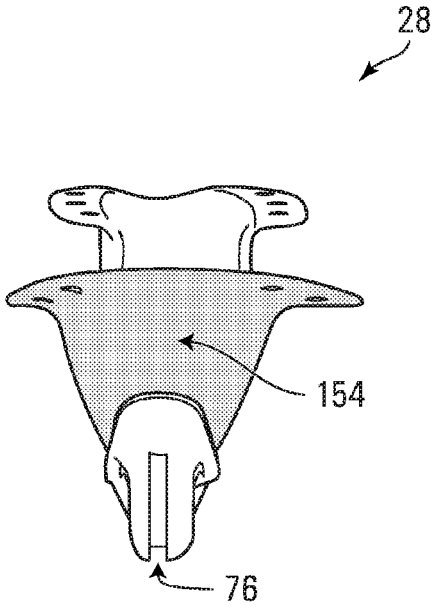
Figure 9:
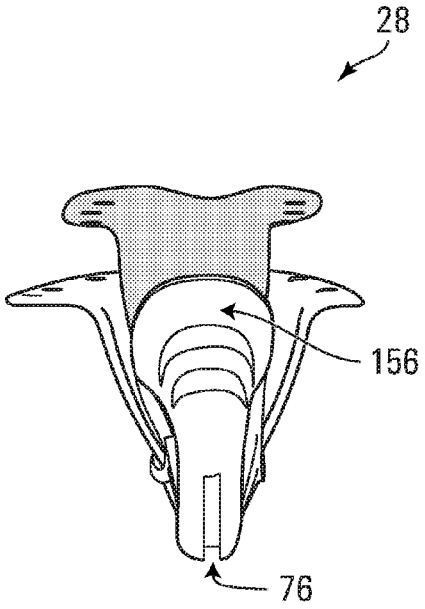
Figure 10:
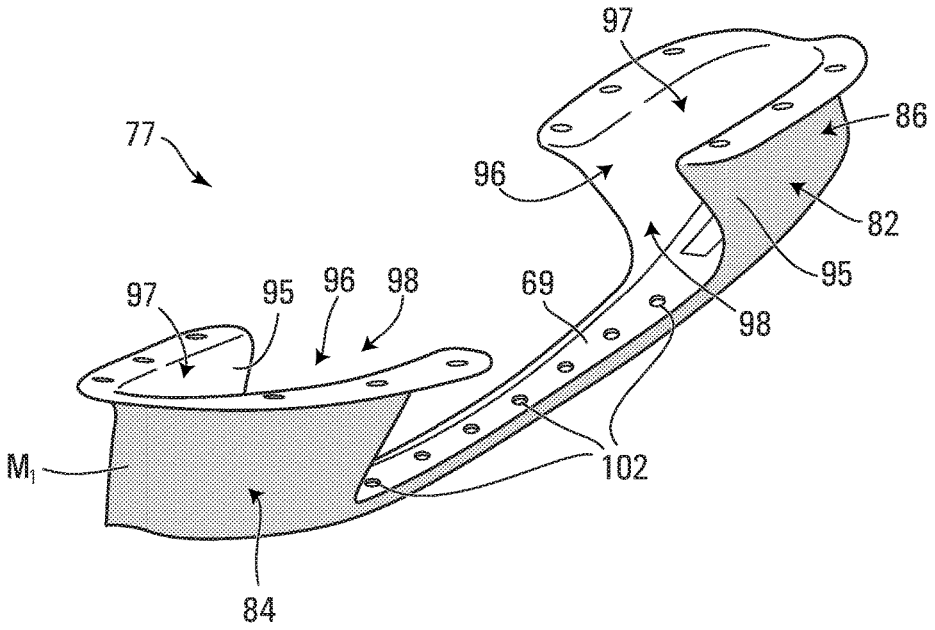
FIGS. 10 to 15 are various views of an upper component of the blade holder.
Figure 11:
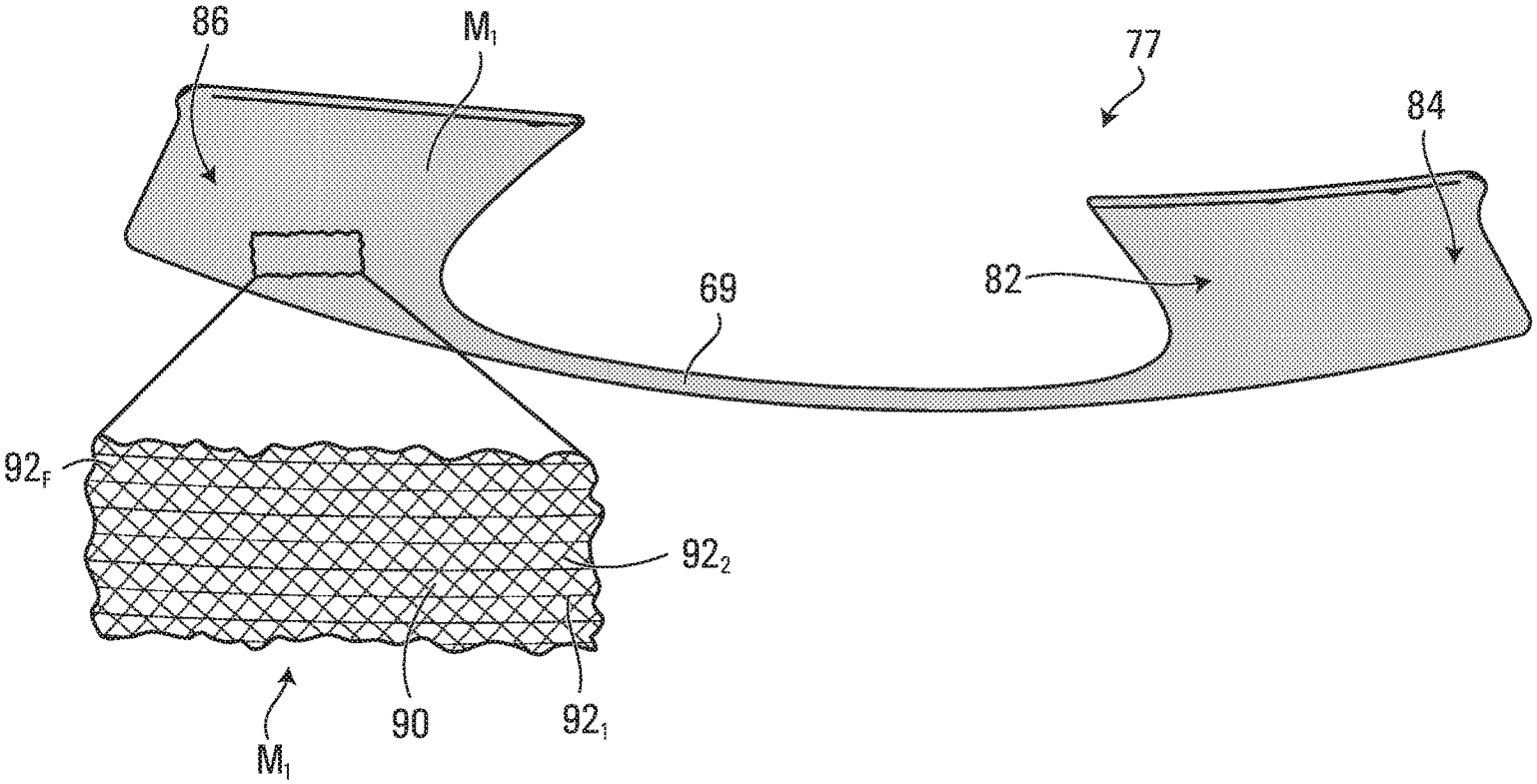
Figure 12:
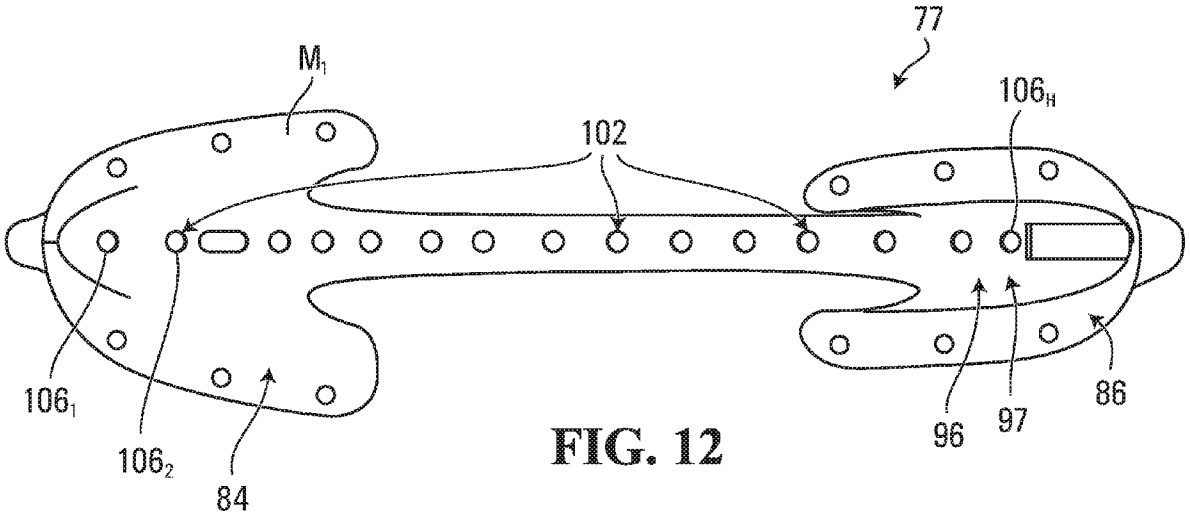
Figure 13:
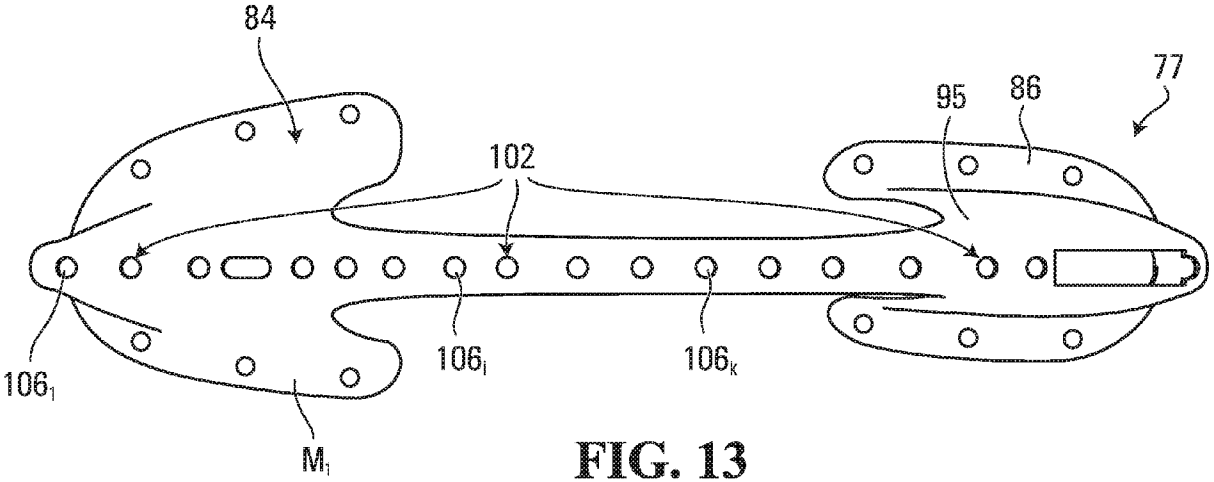
Figure 14:
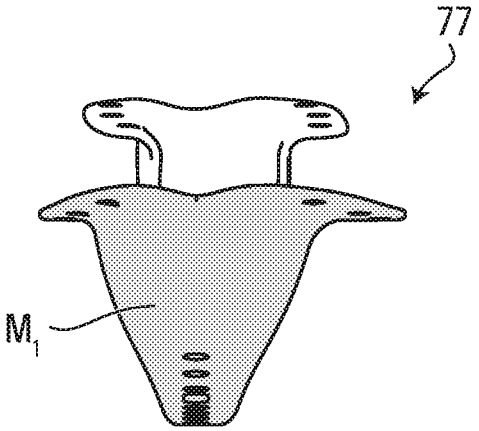
Figure 15:
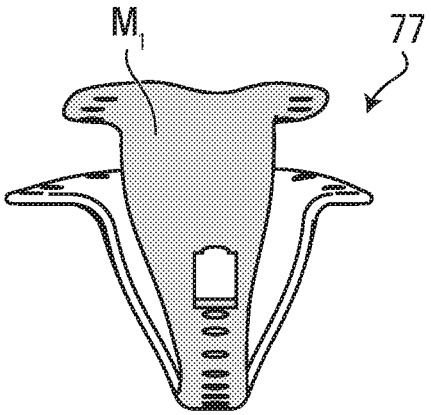
Figure 16:
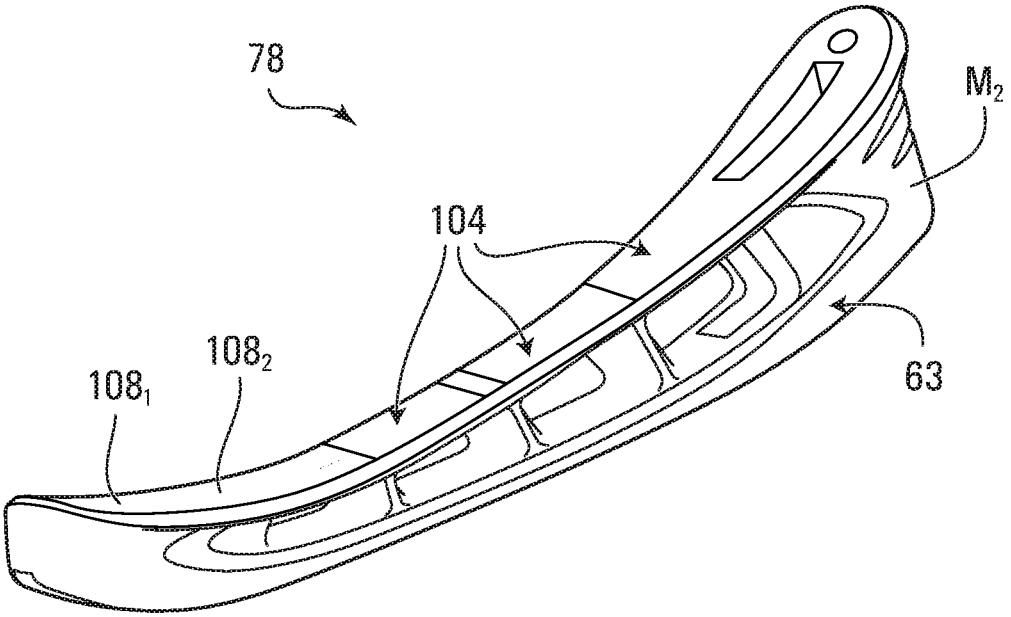
FIGS. 16 to 21 are various views of a lower component of the blade holder.
Figure 17:
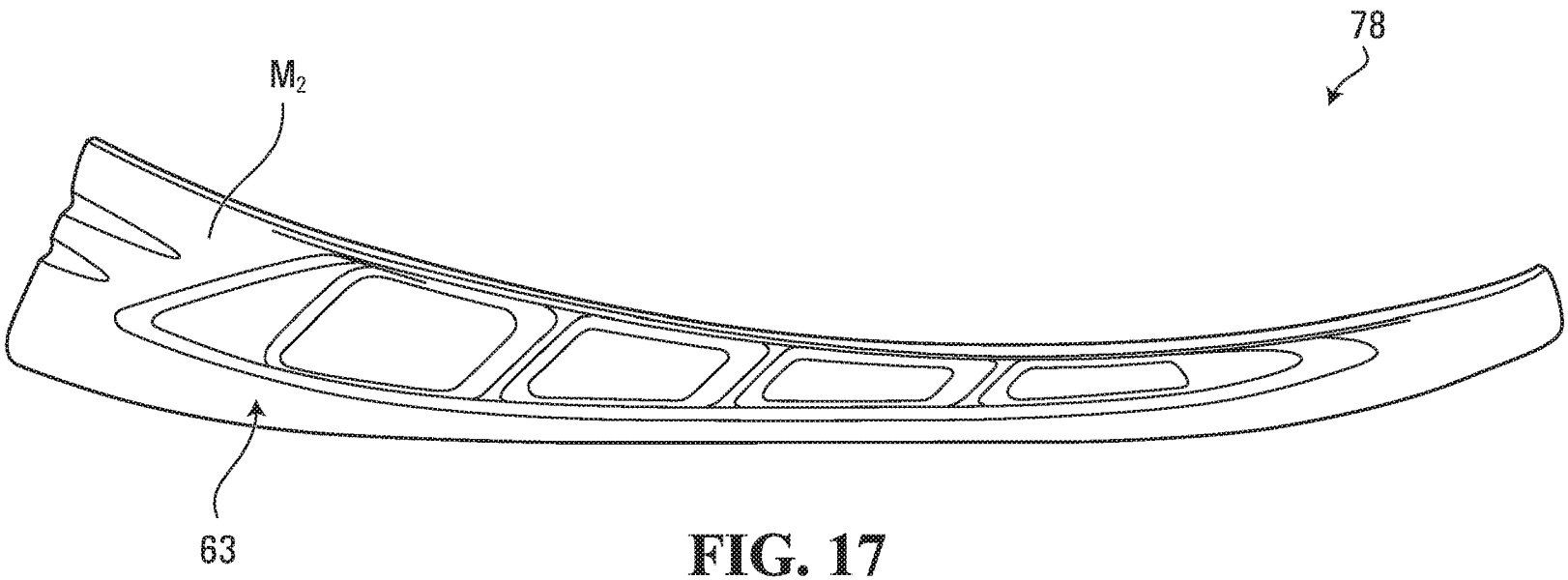
Figure 18:
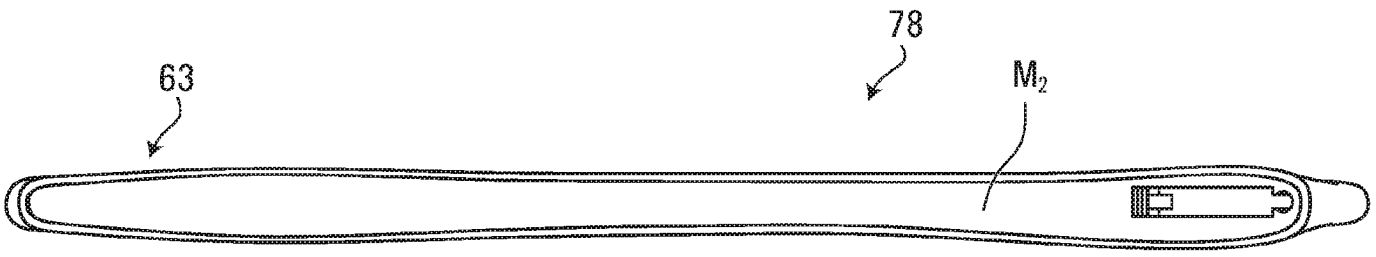
Figure 19:
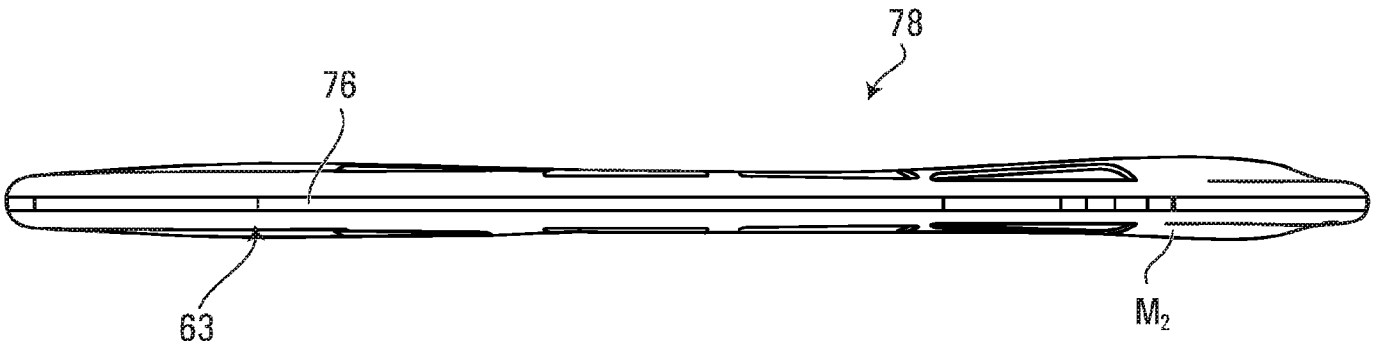
Figure 20:
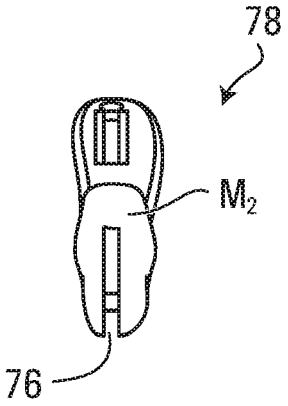
Figure 21:
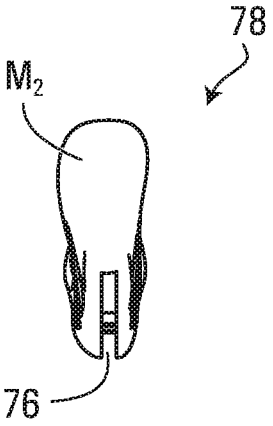

In this embodiment, as shown in FIG. 5, a maximal longitudinal dimension LP (i.e., a maximal dimension in the longitudinal direction of the blade holder 28) of each of the front and rear pillars 84, 86 may be relatively significant. For instance, in some embodiments, a ratio LP/L of the maximal longitudinal dimension LP of the front pillar 84 or the rear pillar 86 over the length L of the blade holder 28 may be at least 0.2, in some cases at least 0.3, and in some cases even more (e.g., 0.4).

With continued reference to FIGS. 3 to 21, in this embodiment, since it includes the composite material $M_1$ providing greater stiffness, parts of the blade holder 28 that are made of the composite material $M_1$ may be reduced in size in order to reduce the weight of the blade holder 28.

For instance, in this embodiment, the blade holder 28 comprises a void 94 between the front and rear pillars 84, 86 that may be relatively large and thus help to reduce its weight. Notably, in this example, the front and rear pillars 84, 86 are significantly spaced apart in the longitudinal direction of the blade holder 28. A longitudinal extent V of the void 94 (i.e., a maximal distance between the front and rear pillars 84, 86 in the longitudinal direction of the blade holder 28) is relatively large and a minimal longitudinal dimension C of each of the front and rear pillars 84, 86 (i.e., a minimal dimension in the longitudinal direction of the blade holder 28 of each of the front and rear pillars 84, 86) may be relatively small.

For example, in some embodiments, the longitudinal extent V of the void 94 between the front and rear pillars 84, 86 may be greater than a sum of the minimal longitudinal dimension C of the front pillars 84 and the minimal longitudinal dimension C of the rear pillar 86.

As another example, in some embodiments, the longitudinal extent V of the void 94 between the front and rear pillars 84, 86 may be greater than the minimal longitudinal dimension C of each of the front and rear pillars 84, 86. For instance, in some embodiments, a ratio V/C of the longitudinal extent V of the void 94 between the front and rear pillars 84, 86 over the minimal longitudinal dimension C of each of the front and rear pillars 84, 86 may be at least 1.8, in some cases at least 2, in some cases at least 2.2, and in some cases even greater. This ratio may have any other value in other embodiments.

As yet another example, in some embodiments, a ratio V/L of the longitudinal extent V of the void 94 between the front and rear pillars 84, 86 over the length L of the blade holder 28 may be at least 0.4, in some cases at least 0.5, in some cases at least 0.6, and in some cases even greater. This ratio may have any other value in other embodiments.

For instance, in this embodiment, the length L of the blade holder 28 may be about 30 cm, the minimal longitudinal dimension C of the front pillar 84 may be about 7 cm, the minimal longitudinal dimension C of the rear pillar 86 may be about 7 cm, and the longitudinal extent V of the void 94 between the front and rear pillars 84, 86 may be about 15 cm for a size 8. The length L of the blade holder 28, the minimal longitudinal dimension C of each of the front and rear pillars 84, 86, and the longitudinal extent V of the void 94 between the front and rear pillars 84, 86 may have any other suitable values in other embodiments.

In this embodiment, each of the front and rear pillars 84, 86 comprises a wall 95 that defines a cavity 96. In this example, the wall 95 is made of the composite material $M_1$ and can be relatively thin. For instance, in some embodiments, a thickness T of the wall 95 may be no more than 5 mm, in some cases no more than 4 mm, in some cases no more than 3 mm, in some cases no more than 2 mm, and in some cases even less. The thickness T of the wall 95 may have any other suitable value in other embodiments.

In this example of implementation, each of the front and rear pillars 84, 86 comprises a top opening 97 that leads to its cavity 96 and faces the skate boot 11 when the blade holder 28 is mounted to the skate boot 11.

Also, in this example of implementation, each of the front and rear pillars 84, 86 comprises a peripheral opening 98 that leads to its cavity 96 such that its cavity 96 is exposed from outside of the skate 10 when the blade holder 28 is mounted to the skate boot 11. That is, each of the front and rear pillars 84, 86 is open peripherally such that its cavity 96 opens up to the outside of the skate 10 when the blade holder 28 is mounted to the skate boot 11. More particularly, in this example of implementation, the peripheral opening 98 of the front pillar 84 and the peripheral opening 98 of the rear pillar 86 face one another.

Therefore, in this embodiment, even though it includes significant parts made of the composite material $M_1$, in view of a reduction in size of these parts and/or use of the polymeric material $M_2$ which is less dense, the weight of the blade holder 28 can be relatively low. For example, in some embodiments, a ratio of the weight of the blade holder 28 over the length L of the blade holder 28 may be no more than 4.3 g/cm, in some cases no more than 4 g/cm, in some cases no more than 3.7 g/cm, in some cases no more than 3.5 g/cm, and in some cases even less (e.g., no more than 3.3 g/cm). For instance, in some embodiments, if the length L of the blade holder 28 is about 30 cm (e.g., for a size 8), the weight of the blade holder 28 may be no more than 130 g, in some cases no more than 120 g, in some cases no more than 110 g, in some cases no more than 105 g, and in some cases even less (e.g., no more than 100 g). The weight of the blade holder 28 may have any other suitable value in other embodiments.

The composite material $M_1$ and the polymeric material $M_2$ making up respective portions of the blade holder 28 may be interconnected in any suitable way.

In this embodiment, the composite material $M_1$ and the polymeric material $M_2$ are mechanically interlocked. That is, the composite material $M_1$ and the polymeric material $M_2$ are in a mechanical interlock relationship in which they are interconnected via a part of the blade holder 28 made of a given one of the composite material $M_1$ and the polymeric material $M_2$ extending into a part of the blade holder 28 made of the other one of the composite material $M_1$ and the polymeric material $M_2$. More specifically, the part of the blade holder 28 made of the given one of the composite material $M_1$ and the polymeric material $M_2$ comprises an interlocking space (e.g., one or more holes, one or more recesses, and/or one or more other hollow areas) into which extends an interlocking portion of the part of the blade holder 28 made of the other one of the composite material $M_1$ and the polymeric material $M_2$.

Figure 28:
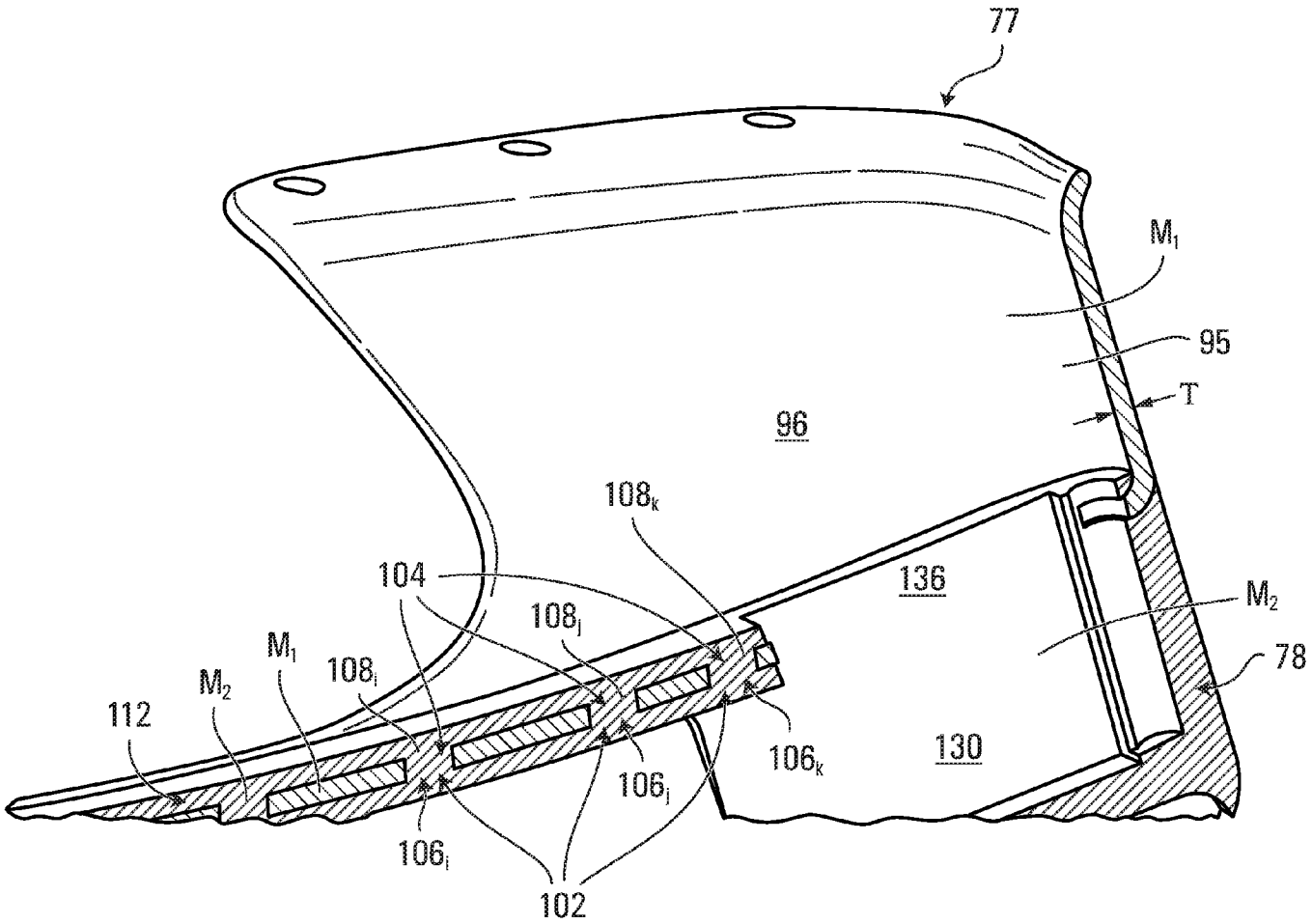

More particularly, in this embodiment, with additional reference to FIG. 28, the upper component 77 of the blade holder 28 made of the composite material $M_1$ and including the front and rear pillars 84, 86 and the thin upper part 69 of the bridge 88 comprises an interlocking space 102 into which extends an interlocking portion 104 of the lower component 78 of the blade holder 28 made of the polymeric material $M_2$ and including the major part 63 of the blade-retaining base 80. In this example, the interlocking space 102 of the upper component 77 of the blade holder 28 made of the composite material $M_1$ comprises a plurality of holes $\mathbf{106}_1$-$\mathbf{106}_H$ (e.g., which may have been pre-molded or drilled) and the interlocking portion 104 of the lower component 78 of the blade holder 28 made of the polymeric material $M_2$ comprises a plurality of elements $\mathbf{108}_1$-$\mathbf{108}_H$ that extend into respective ones of the holes $\mathbf{106}_1$-$\mathbf{106}_H$ to interlock the composite material $M_1$ and the polymeric material $M_2$ together.

In this example of implementation, the blade holder 28 is manufactured using an overmolding process in which the polymeric material $M_2$ is overmolded onto the composite material $M_1$ to create an overmolded joint 112 between the polymeric material $M_2$ and the composite material $M_1$. More particularly, during the overmolding process, the polymeric material $M_2$ flows into the holes $\mathbf{106}_1$-$\mathbf{106}_H$ of the upper component 77 of the blade holder 28 made of the composite material $M_1$ where it is captured to mechanically interlock the polymeric material $M_2$ and composite material $M_1$ at the joint 112. In some cases, the thermoplastic material $M_2$ and the matrix 90 of the composite material $M_1$ may enhance retention of the materials $M_1$, $M_2$ together (e.g., by creating a chemical bond between them).

More particularly, in this example of implementation, the upper component 77 of the blade holder 28 made of the composite material $M_1$ may be manufactured by providing a plurality of layers of fibers, which are destined to provide the fibers $\mathbf{92}_1$-$\mathbf{92}_F$ of the composite material $M_1$, onto one another on a supporting structure which is then placed in a mold to consolidate the composite material $M_1$. In this embodiment, each of these layers of fibers is provided as a pre-preg (i.e., pre-impregnated) layer of fibers held together by an amount of matrix material, which is destined to provide a respective portion of the matrix 90 of the composite material $M_1$. The supporting structure onto which the pre-preg layers of fibers are layered may be implemented in any suitable manner (e.g., one or more silicone mold parts, one or more inflatable bladders, etc.). In other embodiments, the matrix 90 of the composite material $M_1$ may be provided separately from (e.g., injected onto) the layers of fibers. The holes $\mathbf{106}_1$-$\mathbf{106}_H$ for eventual interlocking of the polymeric material $M_2$ may be molded in the mold in which the composite material $M_1$ is consolidated or may be drilled after consolidation of the composite material $M_1$ in the mold. Various other manufacturing techniques may be used to make the upper component 77 of the blade holder 28 made of the composite material $M_1$.

Once the upper component 77 of the blade holder 28 made of the composite material $M_1$ is formed, in this example of implementation, the lower component 78 of the blade holder 28 made of the polymeric material $M_2$ may be manufactured by overmolding the polymeric material $M_2$ onto the composite material $M_1$. For instance, the polymeric material $M_2$ may be injected into a mold in which the upper component 77 of the blade holder 28 is disposed.

Figure 38:
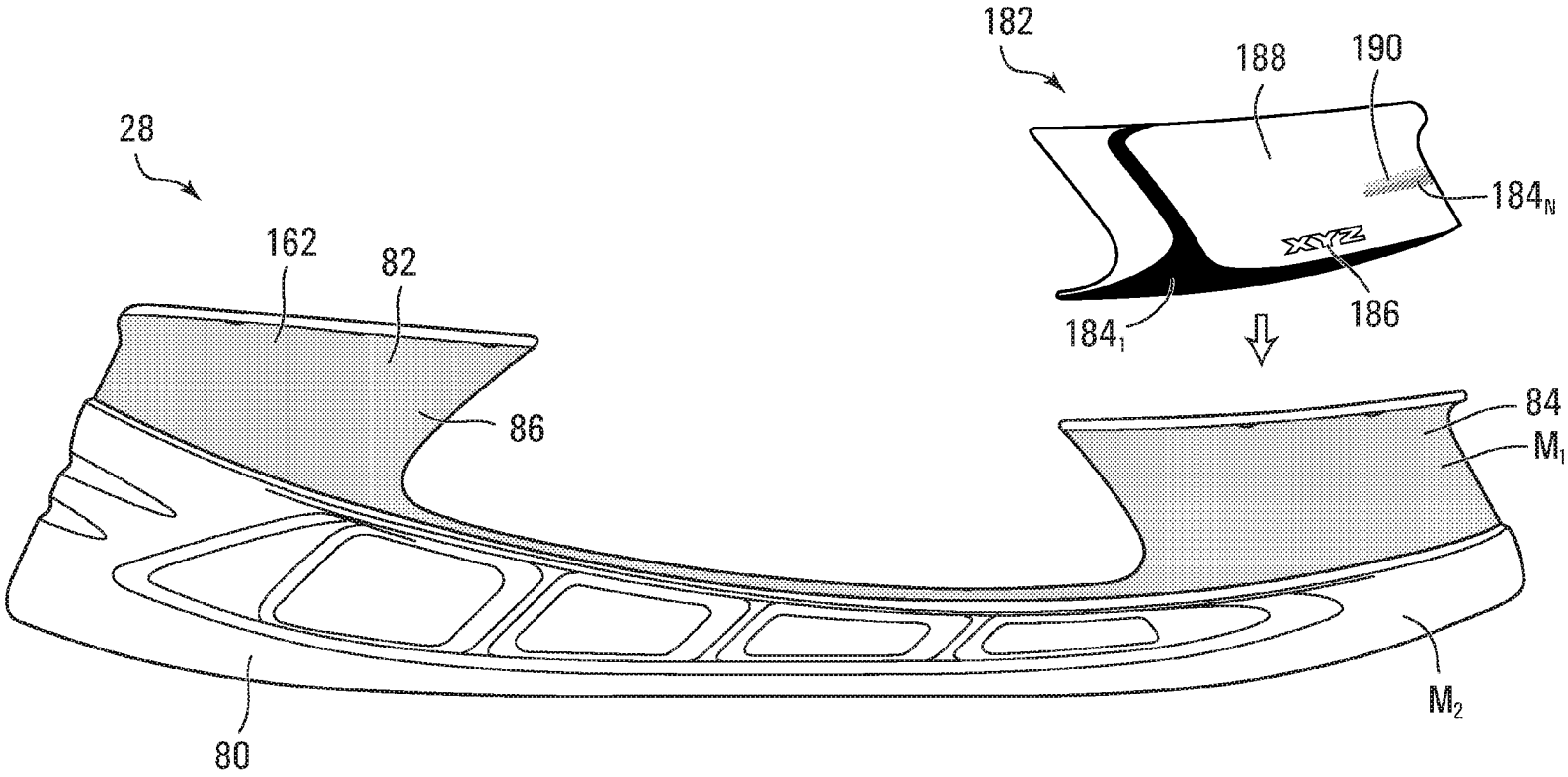
FIG. 38 shows an example of an embodiment in which the support of the blade holder comprises an overlay.

At this stage, in some embodiments, as shown in FIG. 38, an overlay 182 may be provided on the exterior 27 of the blade holder 28 to provide a particular aesthetic appearance to the blade holder 28. For instance, in this embodiment, the overlay 182 may be provided on the support 82 such that the support 82 comprises the overlay 182.

The overlay 182 may have various different visual characteristics that provide a desired aesthetic appearance to the blade holder 28. For instance, the overlay 182 may comprise a plurality of colors $\mathbf{184}_1$-$\mathbf{184}_N$ (or in some cases a single color). One or more of the colors $\mathbf{184}_1$-$\mathbf{184}_N$ of the overlay 182 may be different from the color 137 of the blade-retaining base 80. For example, a color $\mathbf{184}_1$ of the overlay 182 may be darker than the color 137 of the blade-retaining base 80. Moreover, in some embodiments, the overlay 182 may exhibit a gradual variation between respective ones of its colors $184_1$-$184_N$. That is, the overlay 182 may comprise a transition region (not shown) between given ones of the different colors $184_1$-$184_N$ where a given one of the colors $184_1$-$184_N$ of the overlay 182 gradually (i.e., rather than abruptly) changes into an other of the colors $184_1$-$184_N$ of the overlay 182.

In some embodiments, the overlay 182 may comprise a graphic 186. For example, the graphic 186 may be a shape, a symbol, a word, a picture or any other suitable type of visual element.

Moreover, in some embodiments, at least part of the overlay 182 may be transparent. That is, the overlay 182 may comprise a transparent region 188 through which a person can see such that a surface of the material $M_1$ of the support 82 underlying the transparent region 188 is visible through the overlay 182. In such embodiments, the overlay 182 and the surface of the material $M_1$ underlying the transparent region 188 of the overlay 182 form part of the exterior 162 of the support 82. The transparent region 188 may vary in size in accordance with different embodiments. For instance, the transparent region 188 of the overlay 182 may extend throughout substantially an entirety of the overlay 182 such that substantially an entirety of the overlay 182 is transparent. In addition, in some embodiments, the overlay 182 may exhibit a gradual variation in transparency. That is, the overlay 182 may comprise a transition region 190 between its transparent region 188 and a non-transparent region (i.e., a more opaque region) of the overlay 182, the transition region 190 being less transparent than the transparent region 188 but more transparent than the non-transparent region of the overlay 182.

The overlay 182 may be disposed on the support 82 of the blade holder 28 in various ways. For instance, in some embodiments, the overlay 182 may be adhesively bonded to the material $M_1$ of the support 82. For example, in such cases, the overlay 182 may be a sticker. In other embodiments, the overlay 182 may be a decal that is configured to transfer a design (e.g., its colors, graphics, etc.) onto the material $M_1$ of the support 82.

The blade holder 28 can be manufactured using any other suitable process in other embodiments.

In this embodiment, the blade-detachment mechanism 55 of the blade holder 28 to selectively attach and detach the blade 52 to and from the blade holder 28 is disposed in a cavity 130 defined by a wall 132 of the blade-retaining base 80 made of the polymeric material $M_2$. The polymeric material $M_2$ is thus disposed between the blade 52 and the composite material $M_1$. The greater compliance of the polymeric material $M_2$, and possibly its greater ductility, may help to isolate the composite material $M_1$ from the blade 52 and the blade-detachment mechanism 55 and thus reduce a potential for rattling or other vibrations to be transmitted to the composite material $M_1$ (e.g., thereby reducing a potential for local stresses and crack formation in the composite material $M_1$). The polymeric material $M_2$ may thus serve as a "bumper" between the blade 52 and the composite material $M_1$. In this example, the cavity 130 is contiguous to the cavity 96 defined by the wall 95 of the rear pillar 86 such that an opening 136 links the cavity 130 and the cavity 96 which constitute a common continuous hollow space. In other examples, the cavity 130 may be isolated from the cavity 96 defined by the wall 95 of the rear pillar 86.

The blade 52 comprises an ice-contacting material 140 including an ice-contacting surface 127 for sliding on the ice surface while the skater skates. In this embodiment, the ice-contacting material 140 is a metallic material (e.g., stainless steel). The ice-contacting material 140 may be any other suitable material in other embodiments. Also, in this embodiment, an entirety of the blade 52 is made of the ice-contacting material 140.

The ice skate 10, including the blade holder 28, may be implemented in any other suitable way in other embodiments.

For example, in other embodiments, the substantial parts $160_1$-$160_P$ of the exterior 27 of the blade holder 28 that are colored differently may be arranged in any other suitable manners.

Figure 39:
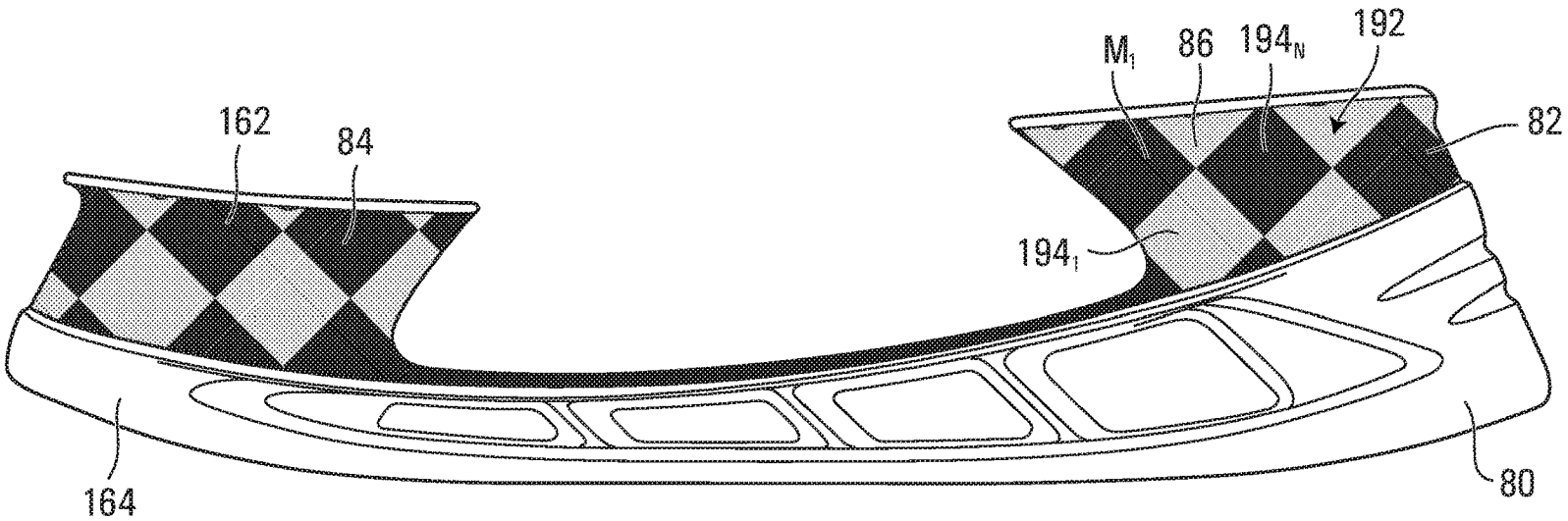
FIG. 39 shows an example of an embodiment in which the exterior of the support of the blade holder comprises a checkered pattern.

For instance, in some embodiments, as shown in FIG. 39, the exterior 27 of the blade holder 28 may comprise a checkered pattern 192. Notably, in some embodiments, the checkered pattern 192 may extend over a substantial part of the exterior 27 of the blade holder 28 but does not extend over another substantial part of the exterior 27 of the blade holder 28.

For example, in this embodiment, the exterior 162 of the support 82 comprises the checkered pattern 192. The checkered pattern 192 may extend over a limited portion of the exterior 162 of the support 82 or, in some cases, may extend over a significant portion of the exterior 162 of the support 82. For instance, in some cases, the checkered pattern 192 may occupy at least 10% of the exterior 162 of the support 82, in some cases at least 25% of the exterior 162 of the support 82, in some cases at least 50% of the exterior 162 of the support 82 (i.e., at least the majority of the exterior 162 of the support 82), in some cases at least 75% of the exterior 162 of the support 82, in some cases at least 90% of the exterior 162 of the support 82, or in some cases even more (e.g., substantially an entirety of the exterior 162 of the support 82).

The checkered pattern 192 may be provided on the exterior 162 of the support 62 in various ways. For instance, in some embodiments, the checkered pattern 192 may be defined by intersecting elements $194_1$-$194_N$ of the composite material $M_1$. For example, the intersecting elements $194_1$-$194_N$ of the composite material $M_1$ may be elements of tape of the composite material $M_1$ that are woven, interlaced or otherwise intersect one another.

In contrast, in this embodiment, at least part of the exterior 164 of the blade-retaining base 80 may be free of checkering. That is, at least part of the exterior 164 of the blade-retaining base 80 may not comprise a checkered pattern like the checkered pattern 192. In this example, at least a majority (i.e., a majority or an entirety) of the exterior 164 of the blade-retaining base 80 is free of checkering. More particularly, in this example, substantially the entirety of the exterior 164 of the blade-retaining base 80 is free of checkering.

Various other configurations of the blade holder 28 may be possible in other embodiments.

Figure 40:
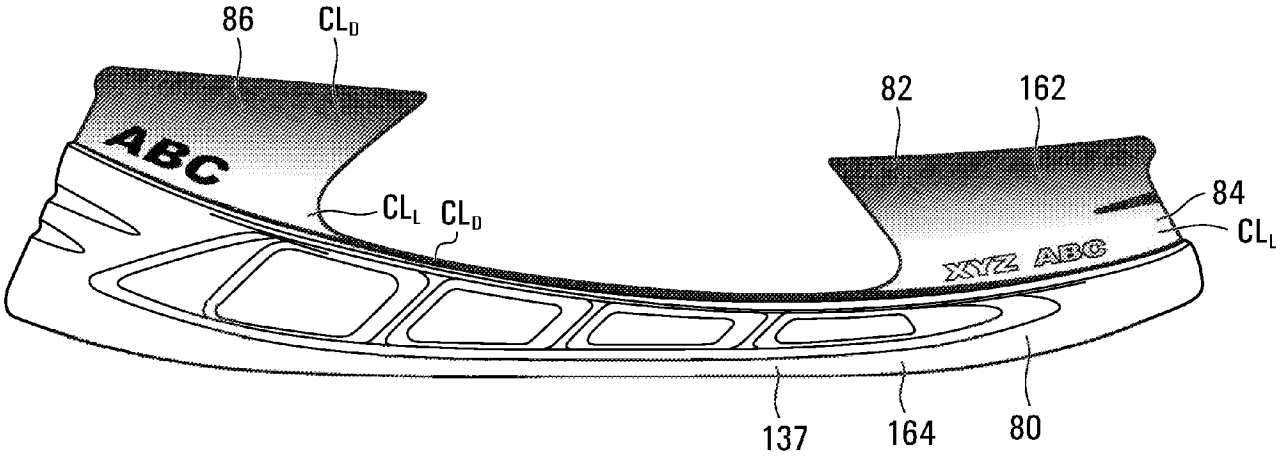
FIGS. 40 to 47 show examples of other color arrangements provided on the exterior of the support of the blade holder in other embodiments.
Figure 41:
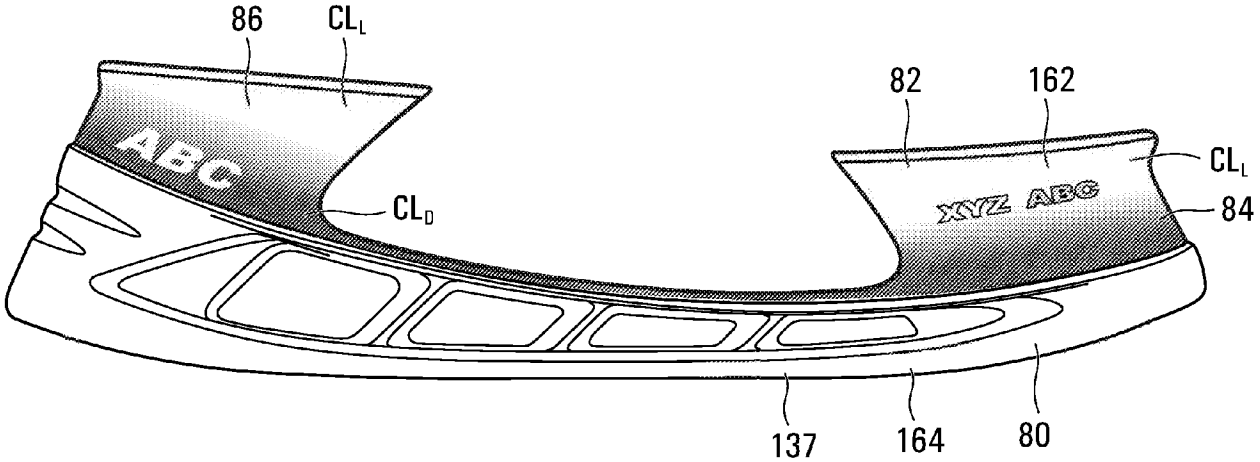

Examples of other possible configurations are shown in FIGS. 40 to 47. For instance, in one example, as shown in FIG. 40, a darker color $CL_D$ of the exterior 162 of the support 82 may be provided at a top portion of each of the front and rear pillars 84, 86 and at a bottom portion of the support 82 (e.g., at an interface with the color 137 of the blade-retaining base 80). A lighter color $CL_L$, for example similar to the color 137 of the blade-retaining base 80, may be provided at an intermediate portion of the support 82 between the top portions of the pillars 84, 86 and the bottom portion of the support 82. In another example, as shown in FIG. 41, the top portion of each of the front and rear pillars 84, 86 may be provided with the lighter color $CL_L$ while the darker color $CL_D$ of the exterior 162 of the support 82 may be provided at the bottom portion of the support 82 exclusively. In both embodiments show in FIGS. 40 and 41, a transition region may be provided between the darker color $CL_D$ of the exterior 162 of the support 82 and the lighter color $CL_L$ of the exterior 162 of the support 82 such that the exterior 162 of the support 82 may exhibit a gradual variation between respective ones of its colors $CL_1$-$CL_N$.

Figure 42:
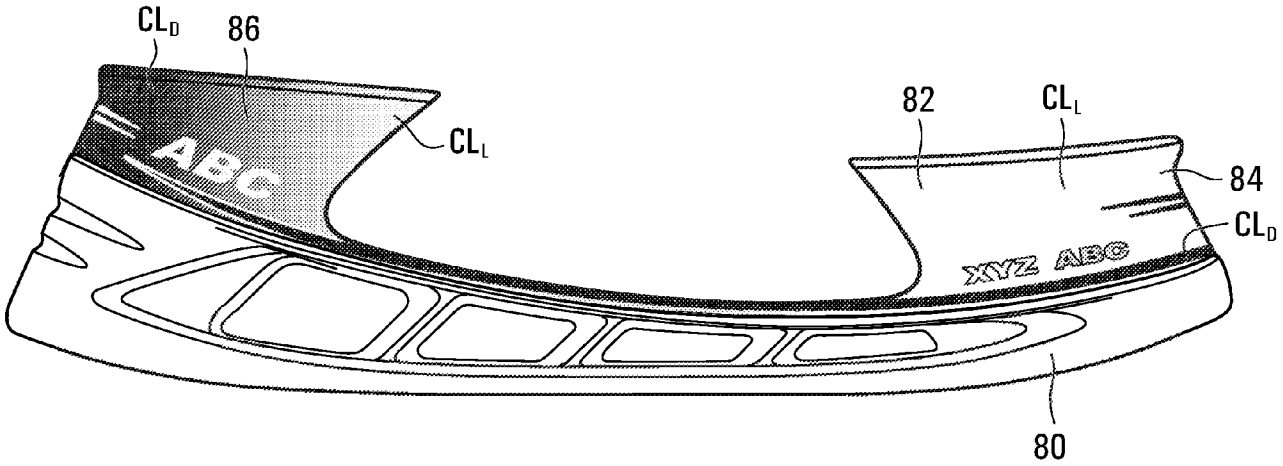

As yet another example, as shown in FIG. 42, the darker color $CL_D$ of the exterior 162 of the support 82 may not necessarily be above or below the lighter color $CL_L$ of the exterior 162 of the support 82. For instance, in this example, the darker color $CL_D$ is positioned rearwardly of the lighter color $CL_L$ such that a transition region between the darker color $CL_D$ and the lighter color $CL_L$ provides a gradual variation between the darker and the lighter colors $CL_D$, $CL_L$ in the longitudinal direction of the blade holder 28. Moreover, in this example, the lighter color $CL_L$ extends along at least a majority of the front pillar 84. Alternatively or additionally, in other examples, the lighter color $CL_L$ may extend along at least a majority of the rear pillar 86.

Figure 43:
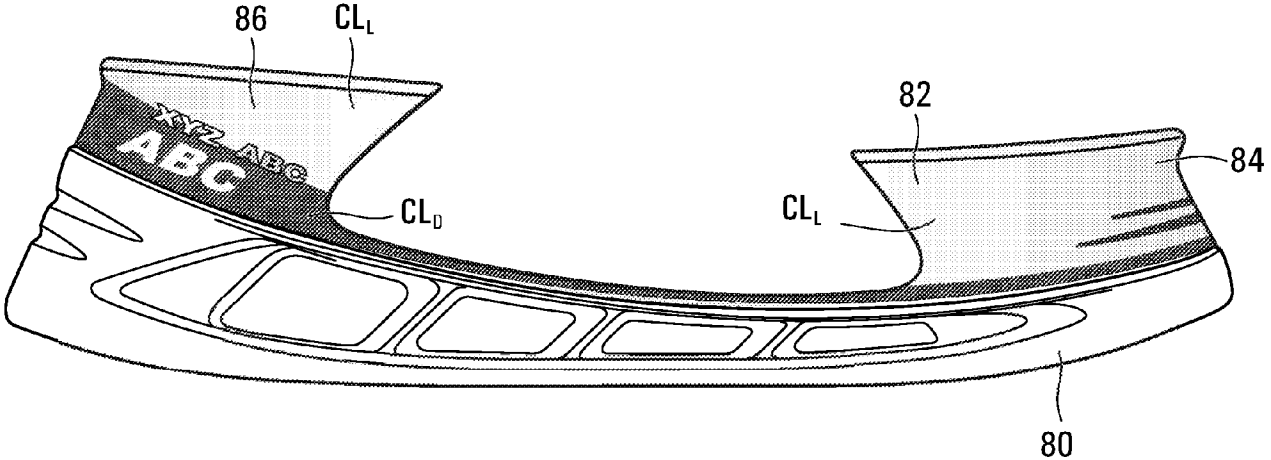

In the example of FIG. 43, the darker color $CL_D$ of the exterior 162 of the support 82 occupies the bottom portion of the support 82 and the exterior 162 of the support 82 has no transition region between the darker color $CL_D$ and the lighter color $CL_L$ and therefore there is an abrupt variation between the colors $CL_D$, $CL_L$ of the exterior 162 of the support 82. In the examples of FIGS. 42 and 43, the darker color $CL_D$ has a greater extent in the rear pillar 86 than in the front pillar 84. That is, the darker color $CL_D$ extends along a greater portion of the rear pillar 86 than a portion of the front pillar 84.

Figure 44:
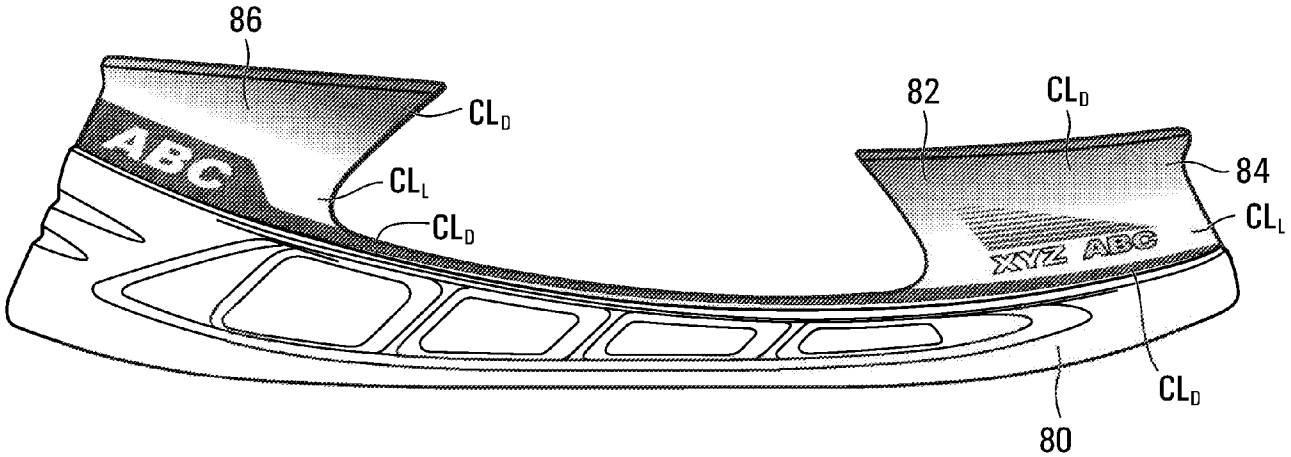

As yet another example, as shown in FIG. 44, the darker color $CL_D$ of the exterior 162 of the support 82 may be provided at the top portion of each of the front and rear pillars 84, 86 and at the bottom portion of the support 84, while the intermediate portion of the support 82 between the top portion of the pillars 84, 86 and the bottom portion of the support 82 is provided with the lighter color $CL_L$. As such, in this example, each of the front and rear pillars 84, 86 comprises a pair of regions that are not continuous to one another and that are provided with the darker color $CL_D$.

Figure 45:
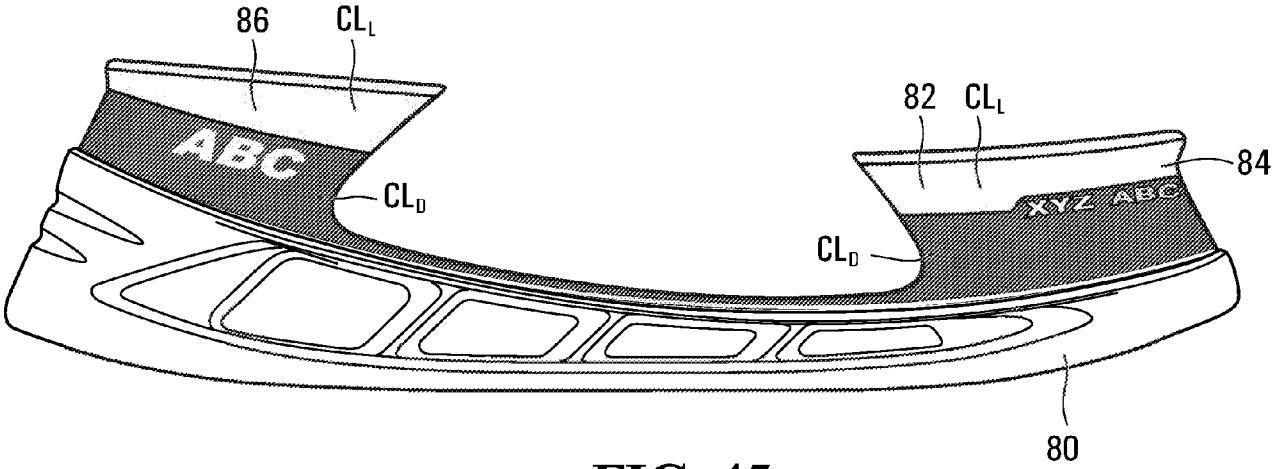

As yet another example, as shown in FIG. 45, the darker color $CL_D$ may occupy at least a majority of the exterior 162 of the support 82. For example, a lighter color (e.g., similar to the color 137 of the blade-retaining base 80) may occupy a small top portion of the front and rear pillars 84, 86 while a remainder of the support 82 is provided with the darker color $CL_D$.

Figure 46:
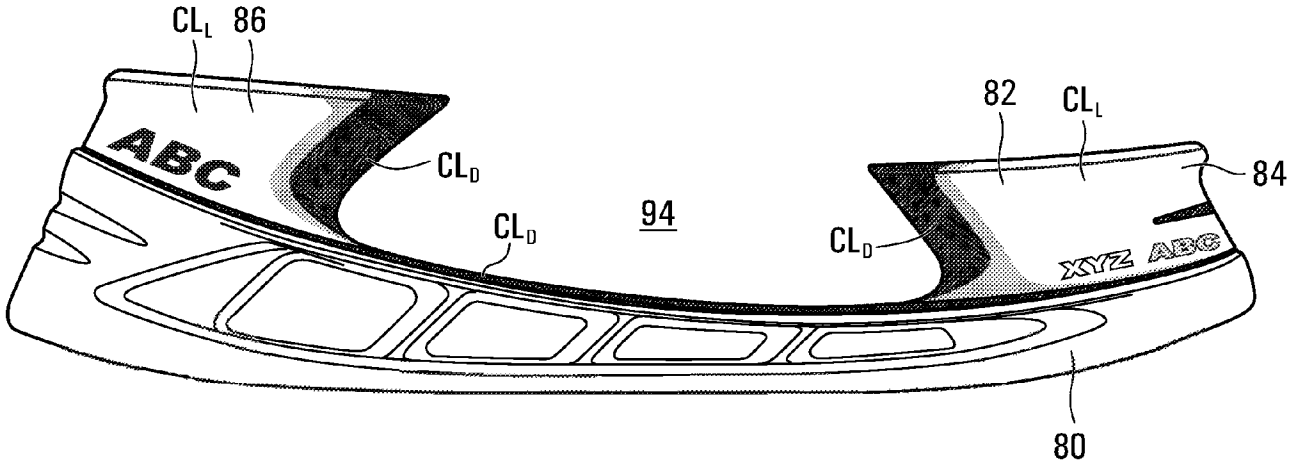

As yet another example, as shown in FIG. 46, the darker color $CL_D$ of the exterior 162 of the support 82 may extend mainly along a region adjacent the void 94 of the blade holder 28. For instance, a rear portion of the rear pillar 86 and a front portion of the front pillar 84 may be provided with a lighter color (e.g., similar to the color 137 of the blade-retaining base 80).

Figure 47:
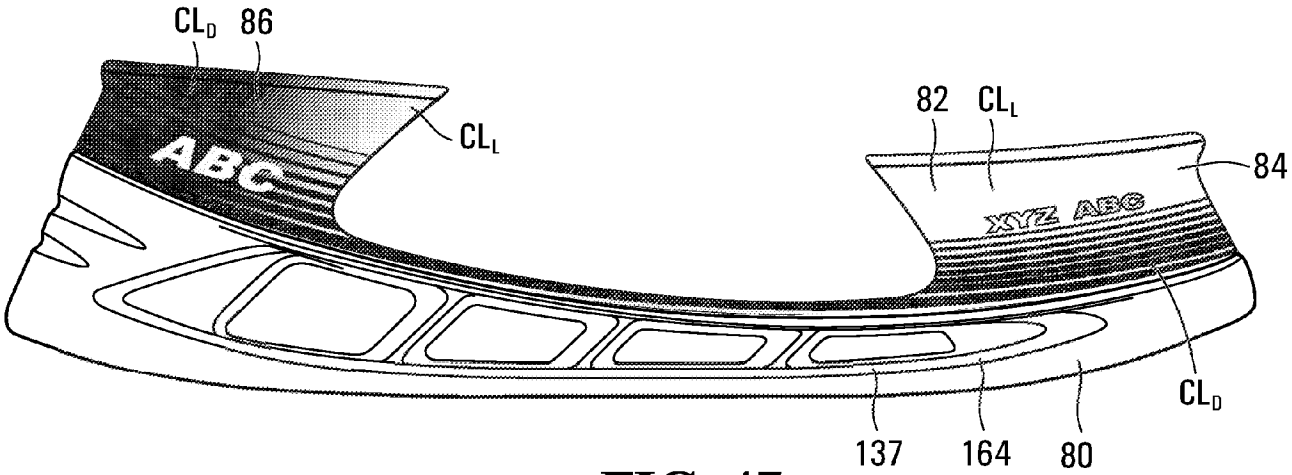

In the example shown in FIG. 47, a majority of the exterior 141 of the rear pillar 86 has the darker color $CL_D$ while about half the exterior 139 of the front pillar has the darker color $CL_D$.

In other embodiments, the blade holder 28 may have any other suitable shape.

Figure 48:
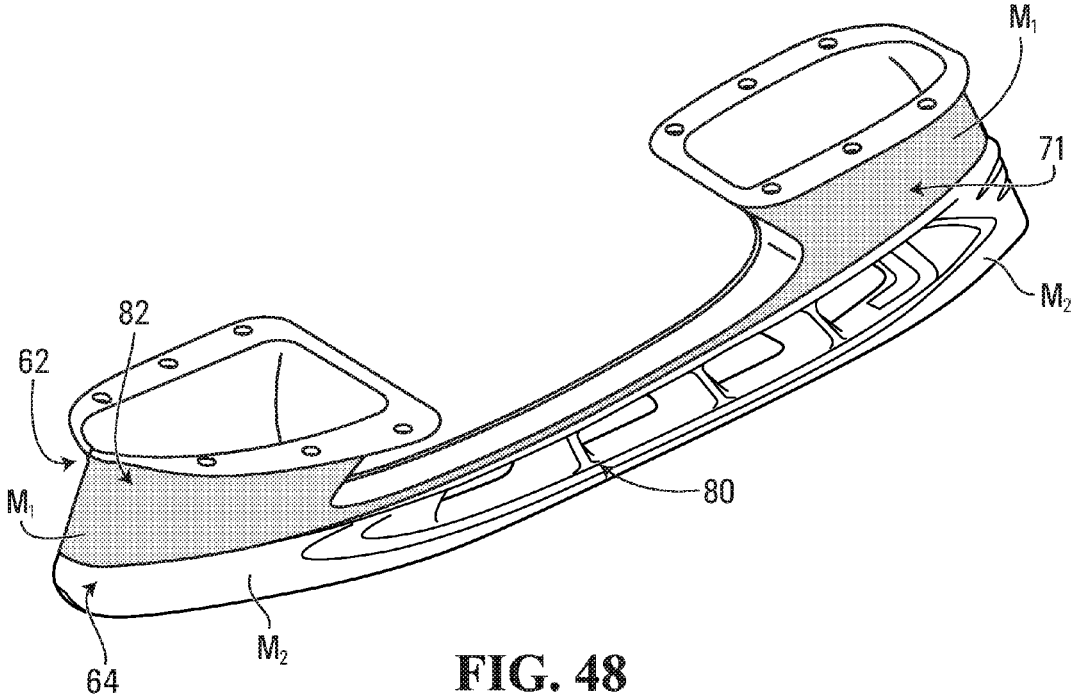
FIGS. 48 to 50 show examples of other shapes of the blade holder in other embodiments.
Figure 49:
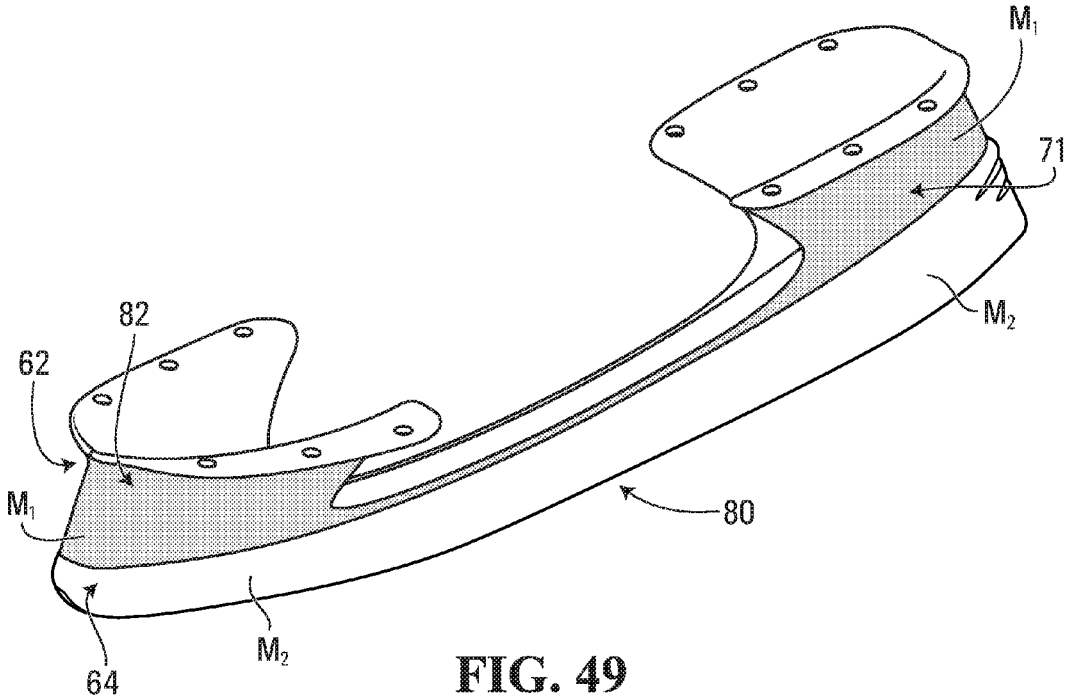
Figure 50:
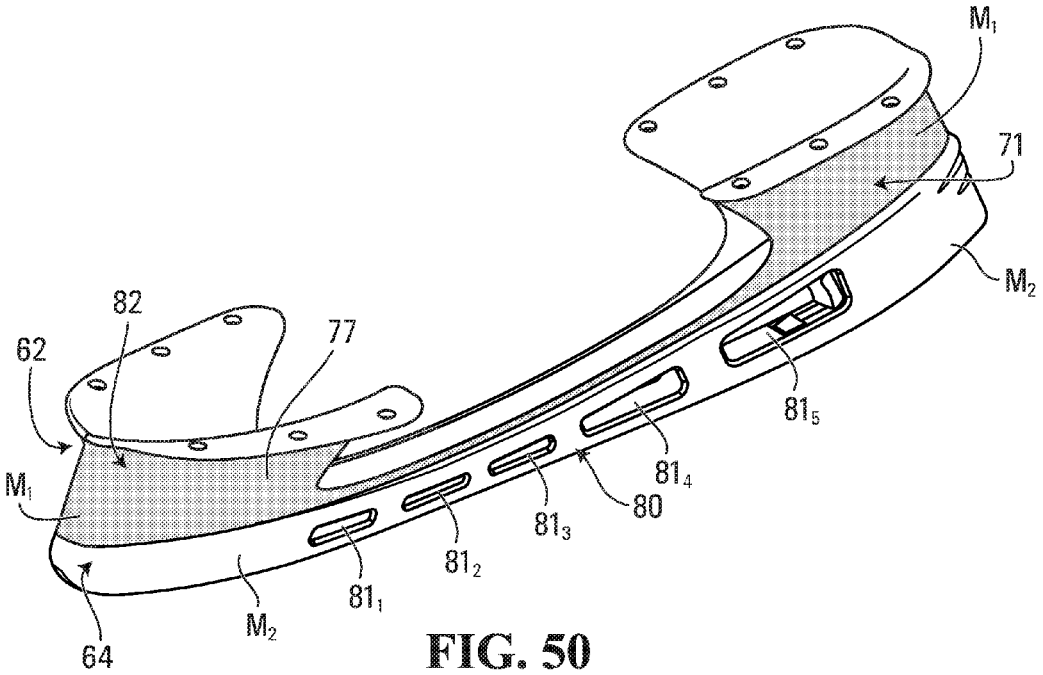
Figure 52:
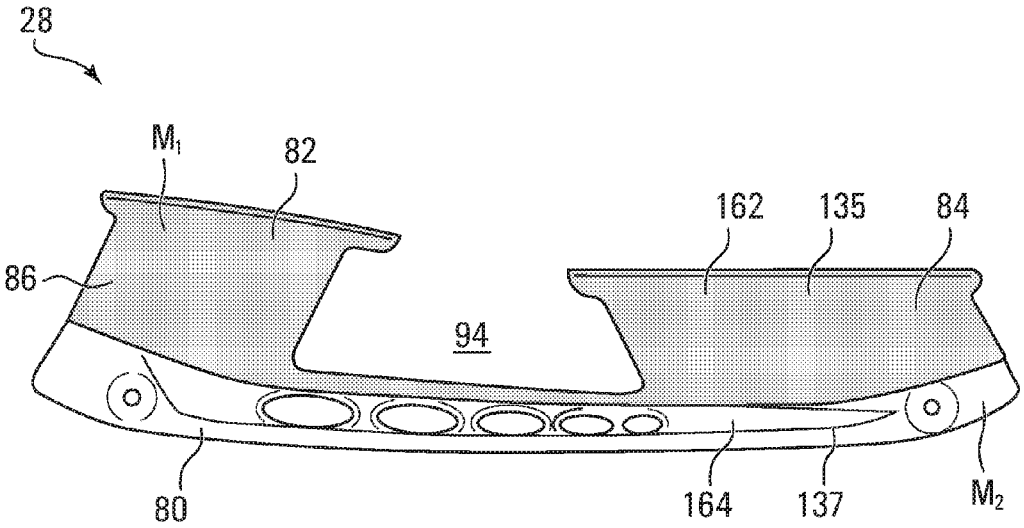
FIG. 52 shows an example of another embodiment of the blade holder in which the blade holder is shaped differently.

For instance, in other embodiments, the support 82 and/or the blade-retaining base 80 may be shaped in various other ways (e.g., the front and rear pillars 84, 86 may be shaped differently; the blade-retaining base 80 may have more, fewer, or no apertures such as the apertures $\mathbf{81}_1$-$\mathbf{81}_4$; etc). As an example, FIG. 48 shows an embodiment in which the front and rear pillars 84, 86 are open only at their top opening 97 (i.e., they lack any peripheral opening such as the peripheral opening 98). As another example, FIG. 50 shows an embodiment in which in which the blade-retaining base 80 has five apertures such as the apertures $\mathbf{81}_1$-$\mathbf{81}_4$. As yet another example, FIG. 49 shows an embodiment in which the blade-retaining base 80 has no apertures such as the apertures $\mathbf{81}_1$-$\mathbf{81}_4$. As yet another example, FIG. 52 shows an embodiment in which the support 82 and the blade-retaining base 80 are shaped differently than in embodiments considered above. For instance, the front and rear pillars 84, 86 of the support 82 may be shaped differently such that the void 94 between the front and rear pillars 84, 86 is shaped differently (e.g., has a more square, rounded, or polygonal shape). At least the majority of the exterior 162 of the support 82 is colored differently than at least the majority of the exterior 164 of the blade-retaining base 80.

Figure 53:
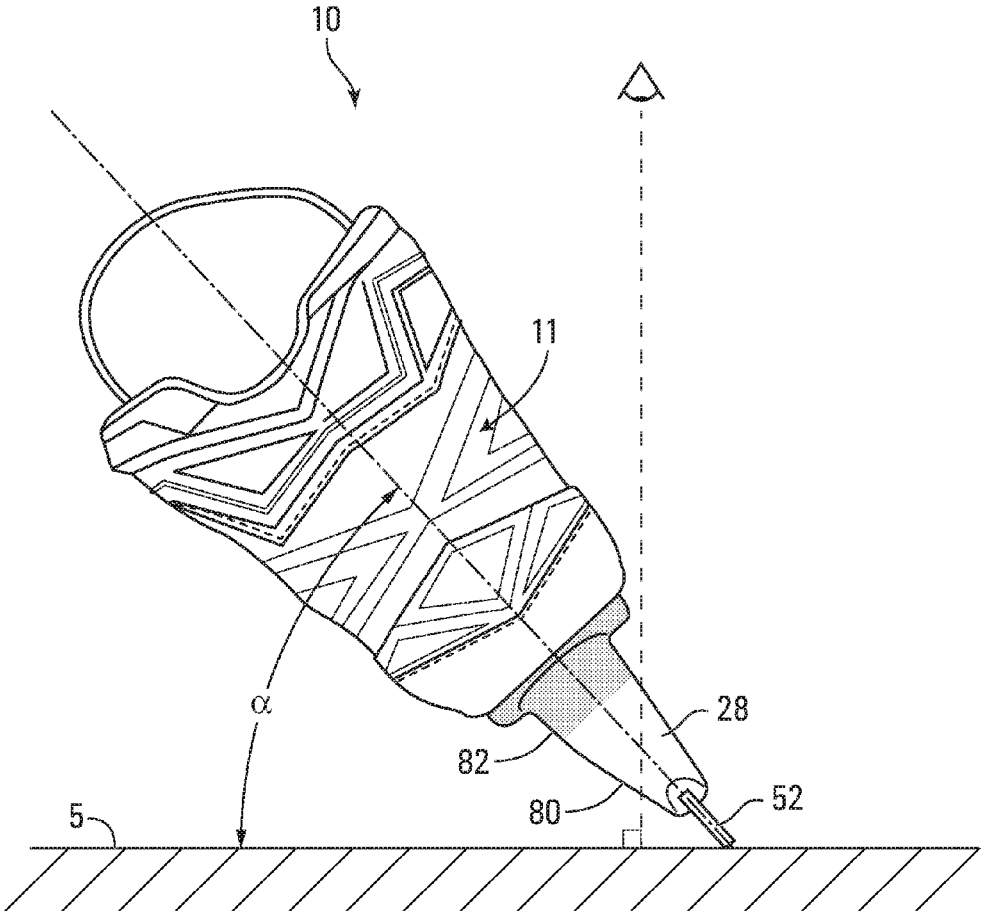
FIG. 53 shows an example of a skater's view of the blade holder when the blade holder is at angle relative to an ice surface on which the skater skates.

As mentioned above, in some situations, blade holders which are too dark may have a visual and/or psychological effect on skaters that may sometimes make them feel as though they are skating slower than they are in reality. In that context, the blade holder 28 may be configured to provide the exterior 162 of the support 82 with a darker portion while ensuring that the skater cannot observe or can observe a limited portion of the darker portion of the exterior 162 of the support 82 while the skater is skating. For instance, with reference to FIG. 53, in some embodiments, the blade holder 28 may be configured such that, when the skate 10 is at an angle $\alpha$ relative to the ice surface 5, at least a majority of the darker portion of the exterior 162 of the support 82 is not visible when viewed perpendicularly to the ice surface 5. In some cases, the angle $\alpha$ may be at least 15°, in some cases at least 20°, in some cases 30°, in some cases 45° and in some cases even more. In other embodiments, the blade holder 28 may not be configured as such.

In other embodiments, the composite material $M_1$ and the polymeric material $M_2$ of the blade holder 28 may be interconnected in any other suitable way.

Figure 51:
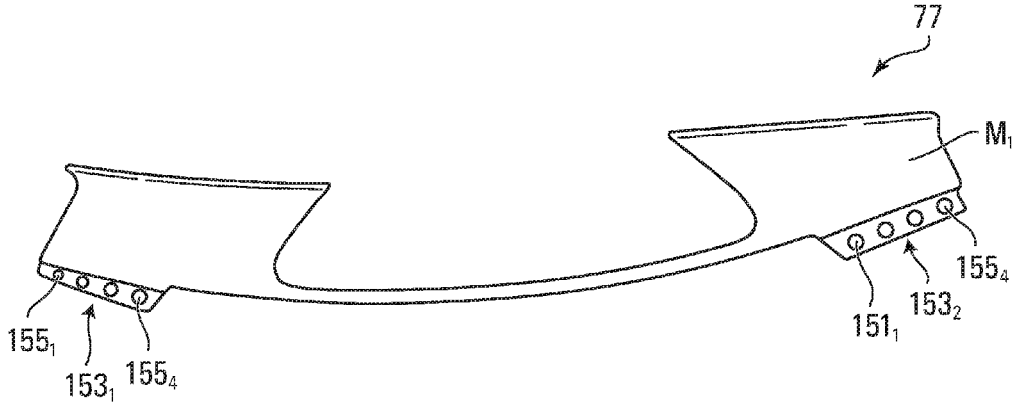
FIG. 51 shows an example of a variant of the upper component of the blade holder.

For example, in some embodiments, as shown in FIGS. 50 and 51, the upper component 77 of the blade holder 28 made of the composite material $M_1$ comprises a plurality of projections $\mathbf{153}_1$,$\mathbf{153}_2$ that project towards the lower component 78 of the blade holder 28 made of the polymeric material $M_2$ and that include part of the interlocking space 102 into which extends the interlocking portion 104 of the lower component 78 of the blade holder 28. In this embodiment, each of the projections $\mathbf{153}_1$,$\mathbf{153}_2$ is a flap, the part of the interlocking space 102 of the upper component 77 of the blade holder 28 formed by each of the flaps $\mathbf{153}_1$,$\mathbf{153}_2$ comprises a plurality of holes $\mathbf{155}_1$,$\mathbf{155}_4$ (e.g., which may have been pre-molded or drilled), and the interlocking portion 104 of the lower component 78 of the blade holder 28 comprises a plurality of elements $\mathbf{168}_1$-$\mathbf{168}_8$ that extend into respective ones of the holes $\mathbf{155}_1$-$\mathbf{155}_4$ of each of the flaps $\mathbf{153}_1$,$\mathbf{153}_2$ to interlock the composite material $M_1$ and the polymeric material $M_2$ together. Thus, in this embodiment, the holes $\mathbf{106}_1$-$\mathbf{106}_H$ and the holes $\mathbf{155}_1$-$\mathbf{155}_4$ of the interlocking space 102 of the upper component 77 of the blade holder 28 are oriented differently such that the elements $\mathbf{108}_1$-$\mathbf{108}_H$ and the elements $\mathbf{168}_1$-$\mathbf{168}_8$ of the interlocking portion 104 of the lower component 78 of the blade holder 28 extend transversally to one another (e.g., in this case, the elements $\mathbf{108}_1$-$\mathbf{108}_H$ extend into the holes $\mathbf{106}_1$-$\mathbf{106}_H$ generally vertically and the elements $\mathbf{168}_1$-$\mathbf{168}_8$ extend into the holes $\mathbf{155}_1$-$\mathbf{155}_4$ generally horizontally). In some cases, this may help to further enhance mechanical interlocking of the composite material $M_1$ and the polymeric material $M_2$.

Figure 29:
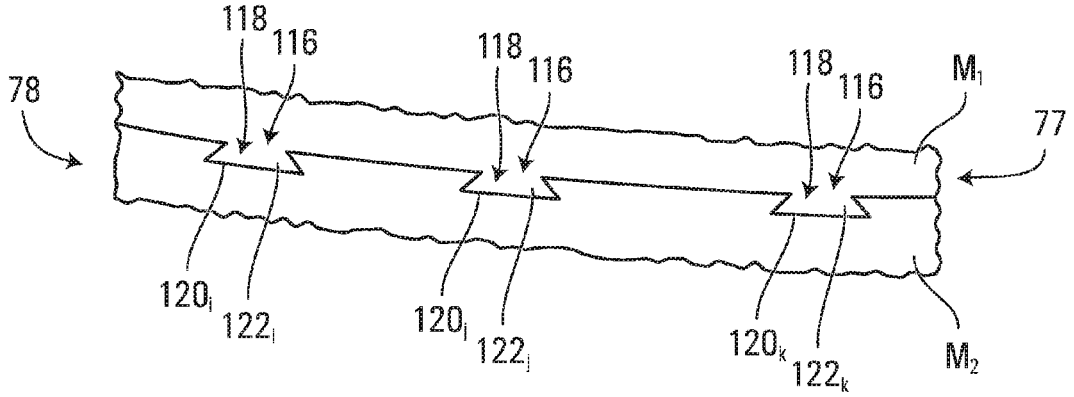
FIGS. 29 to 31 show examples of variants of an interconnection of different parts of the blade holder.

As another example, in some embodiments, as shown in FIG. 29, instead of or in addition to the upper component 77 of the blade holder 28 made of the composite material $M_1$ comprising the interlocking space 102 into which extends the interlocking portion 104 of the lower component 78 of the blade holder 28 made of the polymeric material $M_2$, the lower component 78 of the blade holder 28 made of the polymeric material $M_2$ may comprise an interlocking space 116 into which extends an interlocking portion 118 of the upper component 77 of the blade holder 28 made of the composite material $M_1$. For instance, in this embodiment, the interlocking space 116 of the lower component 78 of the blade holder 28 made of the polymeric material $M_2$ comprises a plurality of holes $\mathbf{120}_1$-$\mathbf{120}_J$ (e.g., which may have been pre-molded or drilled) and the interlocking portion 118 of the upper component 77 of the blade holder 28 made of the composite material $M_1$ comprises a plurality of elements $\mathbf{122}_1$-$\mathbf{122}_J$ that extend into respective ones of the holes $\mathbf{120}_1$-$\mathbf{120}_J$ to interlock the composite material $M_1$ and the polymeric material $M_2$ together. In this example, the thermoplastic resin of the matrix 90 of the composite material $M_1$ when provided (e.g., injected) flows into the holes $\mathbf{120}_1$-$\mathbf{120}_J$ defined by the polymeric material $M_2$ to create the elements $\mathbf{122}_1$-$\mathbf{122}_J$ that interlock the composite material $M_1$ and the polymeric material $M_2$ together.

Figure 30:
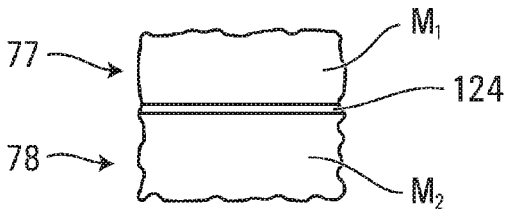

As another example, in some embodiments, as shown in FIG. 30, instead of or in addition to the composite material $M_1$ and the polymeric material $M_2$ being mechanically interlocked, the composite material $M_1$ and the polymeric material $M_2$ may be adhesively bonded by an adhesive 124. The adhesive 124 may be an epoxy-based adhesive, a polyurethane-based adhesive, a methacrylate adhesive, a methyl methacrylate adhesive, or any other suitable adhesive for bonding the composite material $M_1$ and the polymeric material $M_2$.

Figure 31:
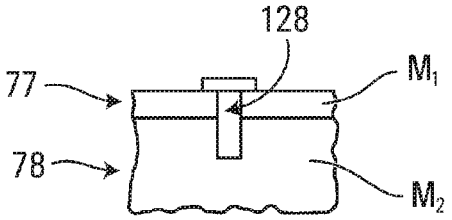

As another example, in some embodiments, as shown in FIG. 31, instead of or in addition to the composite material $M_1$ and the polymeric material $M_2$ being mechanically interlocked and/or adhesively bonded, the composite material $M_1$ and the polymeric material $M_2$ may be fastened using one or more fasteners 128. Each fastener 128 may be a rivet, a screw, a bolt, or any other suitable mechanical fastener While in embodiments considered above the different materials $M_1$, $M_2$ making up respective parts of the blade holder 28 include a composite material and a non-composite polymeric material, the different materials $M_1$, $M_2$ may include any other suitable combination of materials in other embodiments. For example, in some embodiments, the material $M_1$ may be a composite material and the material $M_2$ may be a different composite material (e.g., less stiff than the composite material $M_1$, by including fewer and/or less rigid fibers in its matrix and/or having its matrix more compliant than the composite material $M_1$). For instance, in some embodiments, the composite material $M_1$ may include continuous fibers (e.g., pre-preg layers of fibers) providing a continuous fiber reinforcement as discussed above, while the composite material $M_2$ may include discontinuous (e.g., chopped) fibers randomly dispersed within its matrix. For example, in some cases, the composite material $M_2$ may include a nylon matrix in which are dispersed chopped fibers (e.g., 10% or 20% chopped fibers) such as carbon or aramid fibers, which may also enhance abrasion resistance). Thus, in some embodiments, the composite material $M_2$ may include a polymeric matrix (e.g., nylon) that is reinforced with fibers.

Also, while in embodiments considered above there are two different materials $M_1$, $M_2$ making up respective parts of the blade holder 28, the material distribution profile of the blade holder 28 may include three or more different materials making up respective parts of the blade holder 28 such as described above in relation to the materials $M_1$, $M_2$.

Figure 32:
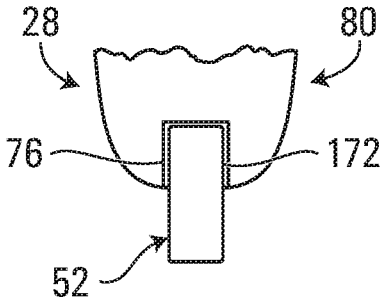
FIGS. 32 to 35 show examples of variants in which the blade holder may retain the blade.
Figure 33:
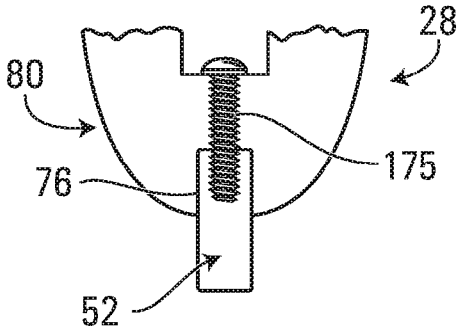
Figure 34:
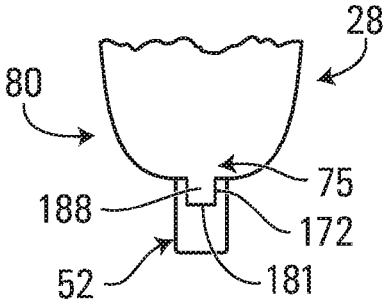
Figure 35:
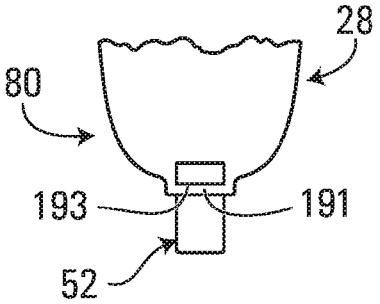

In other embodiments, the blade holder 28 may retain the blade 52 in any other suitable way. For instance, instead of being selectively detachable and removable from and attachable to the blade holder 28, in other embodiments, the blade 52 may be permanently affixed to the blade holder 28 (i.e., not intended to be detached and removed from the blade holder 28). As an example, in some embodiments, as shown in FIGS. 30 and 31, the blade holder 28 may retain the blade 52 using an adhesive 172 and/or one or more fasteners 175. For instance, in some embodiments, as shown in FIG. 32, the recess 76 of the blade holder 28 may receive the upper part of the blade 52 that is retained by the adhesive 172. The adhesive 172 may be an epoxy-based adhesive, a polyurethane-based adhesive, or any suitable adhesive. In some embodiments, instead of or in addition to using an adhesive, as shown in FIG. 33, the recess 76 of the blade holder 28 may receive the upper part of the blade 52 that is retained by the one or more fasteners 175. Each fastener 175 may be a rivet, a screw, a bolt, or any other suitable mechanical fastener. Alternatively or additionally, in some embodiments, as shown in FIG. 34, the blade-retention portion 75 of the blade holder 28 may extend into a recess 181 of the upper part of the blade 52 to retain the blade 52 using the adhesive 172 and/or the one or more fasteners 175. For instance, in some cases, the blade-retention portion 75 of the blade holder 28 may comprise a projection 188 extending into the recess 181 of the blade 52. As another example, in some embodiments, as shown in FIG. 35, the blade 52 and the blade-retaining base 80 of the blade holder 28 may be mechanically interlocked via an interlocking portion 191 of one of the blade-retaining base 80 and the blade 52 that extends into an interlocking void 193 of the other one of the blade-retaining base 80 and the blade 52. For instance, in some cases, the blade 52 can be positioned in a mold used for molding the blade holder 28 such that, during molding, the interlocking portion 191 of the blade-retaining base 80 flows into the interlocking void 193 of the blade 52 (i.e., the blade holder 28 is overmolded onto the blade 52).

Figure 36:
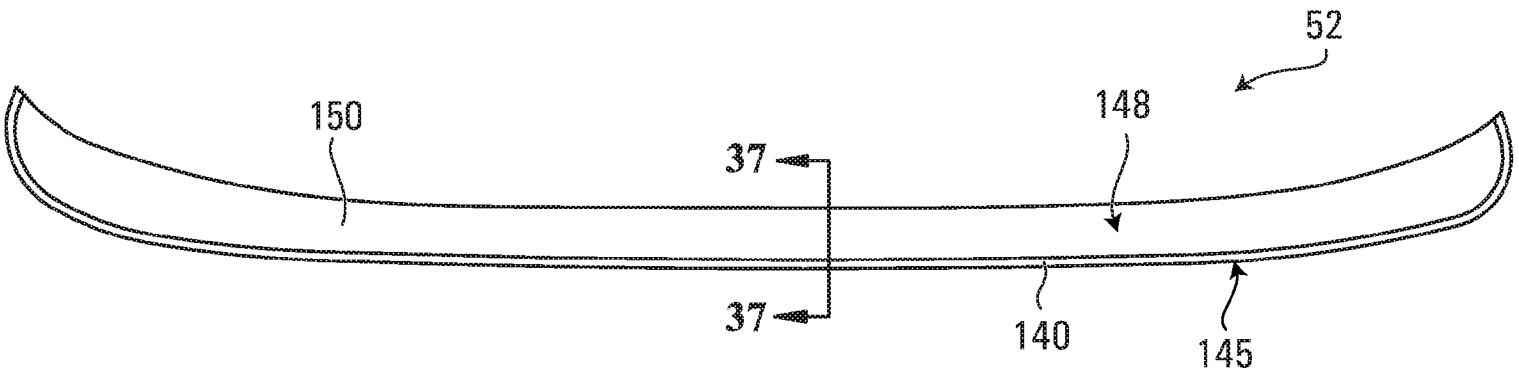
FIGS. 36 and 37 show an example of a variant of the blade.
Figure 37:
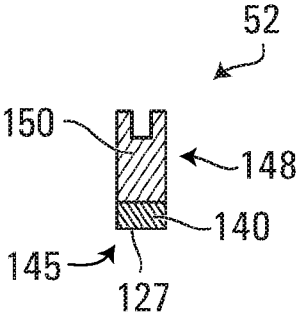

The blade 52 may be implemented in any other suitable way in other embodiments. For example, in some embodiments, as shown in FIGS. 36 and 37, the blade 52 may comprise a runner 145 that is made of the ice-contacting material 140 and includes the ice-contacting surface 127 and a body 148 connected to the runner 145 and made of a material 150 different from the ice-contacting material 140. The runner 145 and the body 148 of the blade 52 may be retained together in any suitable way. For example, in some cases, the runner 145 may be adhesively bonded to the body 148 using an adhesive. As another example, in addition to or instead of being adhesively bonded, the runner 145 and the body 148 may be fastened using one or more fasteners (e.g., rivets, screws, bolts, etc.). As yet another example, the runner 145 and the body 148 may be mechanically interlocked by an interlocking portion of one of the runner 145 and the body 148 that extends into an interlocking space (e.g., one or more holes, one or more recesses, and/or one or more other hollow areas) of the other one of the runner 145 and the body 148 (e.g., the body 148 may be overmolded onto the runner 145).

To facilitate the description, any reference numeral designating an element in one figure designates the same element if used in any other figures. In describing the embodiments, specific terminology has been resorted to for the sake of clarity but the invention is not intended to be limited to the specific terms so selected, and it is understood that each specific term comprises all equivalents.

In some embodiments, any feature of any embodiment described herein may be used in combination with any feature of any other embodiment described herein.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

Although various embodiments have been illustrated, this was for the purpose of describing, but not limiting, the invention. Various modifications will become apparent to those skilled in the art and are within the scope of this invention, which is defined more particularly by the attached claims.

The invention claimed is:

1. A blade holder for an ice skate, the ice skate comprising a skate boot for receiving a foot of a skater and a blade for contacting an ice surface, the blade holder comprising:

a blade-retaining base to retain the blade, the blade-retaining base being elongated in a longitudinal direction, the blade having a length in the longitudinal direction; and a support extending upwardly from the blade-retaining base to interconnect the blade holder and the skate boot, the support being configured for being spaced from the blade along the entire length of the blade when the blade is received in the skate boot;

wherein: the blade-retaining base comprises a first material, the first material defining a first external surface of the blade holder, the first external surface being part of an exterior of the blade-retaining base; the support comprises a second material, the second material defining a second external surface of the blade holder, the second external surface being part of an exterior of the support; the first material and the second material are colored differently; the second material is more rigid than the first material; and the blade holder is configured such that, when the skate is at an angle of at least 15° relative to the ice surface while the skater skates wearing the ice skate, at least a majority of the second external surface of the blade holder is not visible when viewed from above the ice skate perpendicularly to the ice surface and in line with the ice skate.

2. The blade holder of claim 1, wherein at least a majority of the exterior of the support is darker than at least a majority of the exterior of the blade-retaining base.

3. The blade holder of claim 1, wherein a color of the exterior of the support that is at least predominant on the exterior of the support is different from a color of the exterior of the blade-retaining base that is at least predominant on the exterior of the blade-retaining base.

4. The blade holder of claim 3, wherein the color of the exterior of the support is darker than the color of the exterior of the blade-retaining base.

5. The blade holder of claim 1, wherein the exterior of the support has more colors than the blade-retaining base.

6. The blade holder of claim 1, wherein the exterior of the support has a plurality of colors.

7. The blade holder of claim 6, wherein the colors of the support include at least three colors.

8. The blade holder of claim 6, wherein the exterior of the support exhibits a gradual variation between respective ones of the colors of the exterior of the support.

9. The blade holder of claim 1, wherein the exterior of the support comprises a checkered pattern.

10. The blade holder of claim 9, wherein the checkered pattern occupies at least a majority of the exterior of the support.

11. The blade holder of claim 1, wherein a color of the second material is darker than a color of the first material.

12. The blade holder of claim 1, wherein the second material is a composite material.

13. The blade holder of claim 1, wherein the first material is a non-composite material.

14. The blade holder of claim 1, wherein the first material is a non-composite thermoplastic and the second material is a carbon-fiber-reinforced plastic.

15. The blade holder of claim 1, wherein the second material is denser than the first material.

16. The blade holder of claim 1, wherein the support comprises a front pillar and a rear pillar that project upwardly from the blade-retaining base and the blade-retaining base comprises a bridge interconnecting the front pillar and the rear pillar.

17. The blade holder of claim 16, wherein at least a majority of an exterior of the front pillar and at least a majority of an exterior of the rear pillar are colored differently than at least a majority of the exterior of the blade-retaining base.

18. The blade holder of claim 17, wherein at least the majority of the exterior of the front pillar and at least the majority of the exterior of the rear pillar are darker than at least the majority of the exterior of the blade-retaining base.

19. The blade holder of claim 17, wherein a color of the exterior of the front pillar that is at least predominant on the exterior of the front pillar and a color of the exterior of the rear pillar that is at least predominant on the exterior of the rear pillar are different from a color of the exterior of the blade-retaining base that is at least predominant on the exterior of the blade-retaining base.

20. The blade holder of claim 19, wherein the color of the exterior of the front pillar and the color of the exterior of the rear pillar are darker than the color of the exterior of the blade-retaining base.

21. The blade holder of claim 1, wherein an interface of different colors of the support and the blade-retaining base extends over at least a substantial part of a length of the blade holder.

22. The blade holder of claim 21, wherein the interface of different colors of the support and the blade-retaining base extends over at least 20% of the length of the blade holder.

23. The blade holder of claim 21, wherein the interface of different colors of the support and the blade-retaining base extends over at least a majority of the length of the blade holder.

24. The blade holder of claim 1, wherein the support is configured to be affixed to the skate boot.

25. The blade holder of claim 1, wherein at least a majority of the exterior of the support is colored differently than at least a majority of the exterior of the blade-retaining base.

26. The blade holder of claim 25, wherein at least 75% of the exterior of the support is colored differently than at least 75% of the exterior of the blade-retaining base.

27. The blade holder of claim 25, wherein at least 90% of the exterior of the support is colored differently than at least 90% of the exterior of the blade-retaining base.

28. The blade holder of claim 25, wherein substantially an entirety of the exterior of the support is colored differently than substantially an entirety of the exterior of the blade-retaining base.

29. The blade holder of claim 1, wherein the blade holder is configured such that, when the skate is at an angle of at least 20° relative to the ice surface while the skater skates wearing the ice skate, at least a majority of the second external surface of the blade holder is not visible when viewed from above the ice skate perpendicularly to the ice surface and in line with the ice skate.

30. The blade holder of claim 1, wherein the blade holder is configured such that, when the skate is at an angle of at least 30° relative to the ice surface while the skater skates wearing the ice skate, at least a majority of the second external surface of the blade holder is not visible when viewed from above the ice skate perpendicularly to the ice surface and in line with the ice skate.

31. A blade holder for an ice skate, the ice skate comprising a skate boot for receiving a foot of a skater and a blade for contacting an ice surface, the blade holder comprising:

a blade-retaining base to retain the blade, the blade-retaining base being elongated in a longitudinal direction, the blade having a length in the longitudinal direction; and a support extending upwardly from the blade-retaining base to interconnect the blade holder and the skate boot, the support being configured for being spaced from the blade along the entire length of the blade when the blade is received in the skate boot;

wherein: the blade-retaining base comprises a first material, the first material defining a first external surface of the blade holder, the first external surface being part of an exterior of the blade-retaining base; the support comprises a second material, the second material defining a second external surface of the blade holder, the second external surface being part of an exterior of the support; the first material has a color indicative of a rigidity of the first material; the second material has a color indicative of a rigidity of the second material and different from the color of the first material; the rigidity of the second material is different from the rigidity of the first material; and the blade holder is configured such that, when the skate is at an angle of at least 15° relative to the ice surface while the skater skates wearing the ice skate, at least a majority of the second external surface of the blade holder is not visible when viewed from above the ice skate perpendicularly to the ice surface and in line with the ice skate.

* * * * *